United States Patent [19]

Kitaguchi et al.

[11] Patent Number: 4,775,610

[45] Date of Patent: Oct. 4, 1988

[54] METHOD FOR THE FORMATION OF PHOTOGRAPHIC IMAGES INCLUDING HEATING STEP

[75] Inventors: Hiroshi Kitaguchi; Kozo Sato; Masatoshi Kato, all of Kanagawa, Japan

[73] Assignee: Fuji Photo Film Co., Ltd., Kanagawa, Japan

[21] Appl. No.: 866,843

[22] Filed: May 27, 1986

[30] Foreign Application Priority Data

May 24, 1985 [JP] Japan ..... 60-111597

[51] Int. Cl.[4] ..... G03C 1/62; G03C 5/54; G03C 7/26

[52] U.S. Cl. ..... 430/350; 430/151; 430/203; 430/617; 430/955; 430/957; 430/959; 430/960

[58] Field of Search ..... 430/151, 203, 955, 957, 430/959, 960, 350, 617

[56] References Cited

U.S. PATENT DOCUMENTS

| | | | |
|---|---|---|---|
| 4,259,437 | 3/1981 | Webb | 430/957 |
| 4,639,408 | 1/1987 | Kitaguchi et al. | 430/955 |
| 4,678,735 | 7/1987 | Kitaguchi et al. | 430/957 |

FOREIGN PATENT DOCUMENTS

| | | | |
|---|---|---|---|
| 0187343 | 7/1986 | European Pat. Off. | 430/955 |

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A method for the formation of a photographic image including a heating step, comprising heating a photographic material in the presence of at least one compound selected from those represented by formulae (I) and(II)

(I)

(II)

wherein

A represents a non-metallic atomic group forming a carbocyclic aromatic ring or a heterocyclic aromatic ring;

X represents a nucleophilic group or a precursor thereof;

Q represnts a hydrogen atom or a substituted or unsubstituted alkyl, cycloalkyl, or aryl group; and PUG represents a photographically useful group.

13 Claims, No Drawings

METHOD FOR THE FORMATION OF PHOTOGRAPHIC IMAGES INCLUDING HEATING STEP

FIELD OF THE INVENTION

The present invention relates to a method for the formation of photographic images including a heating step, and more precisely, to a method for the formation of photographic images including a heating step where a precursor of a photographically useful reagent is used.

BACKGROUND OF THE INVENTION

Photographic techniques using silver halide have heretofore been most widely utilized, as the photographic characteristics thereof such as sensitivity, gradation control, etc., are superior to those of other photographic means such as electrophotography or diazo process. Recently, an improved photographic technique has been developed capable of simply and rapidly forming an image, where the image formation of a silver halide-containing photographic material is carried out by means of a process of heat development instead of a conventional wet process using a liquid developer at room temperature.

A photographic material for heat development is known in this technical field, and various photographic materials for heat development and processes thereof are described, for example, in *Bases of Photographic Industry* (by Corona Publishing, 1979), pp. 553 to 555; *Film Information* (April, 1978), p. 40; *Neblette's Handbook of Photography and Reprography,* 7th Ed. (Van Nostrand Reinhold Company), pp. 32–33; U.S. Pat. Nos. 3,152,904, 3,301,678, 3,392,020 and 3,457,075; and British Patents Nos. 1,131,108 and 1,167,777; and *Research Disclosure,* RD No. 17029 (June, 1978), pp. 9–15.

Many processes have been proposed for formation of color images by heat development. As for means for formation of color images due to binding of a developing agent, as oxidized, and a coupler; U.S. Pat. No. 3,531,286 has proposed a combination of a p-phenylenediamine reducing agent and a phenolic or active methylene coupler; U.S. Pat. No. 3,761,270 describes a p-aminophenol reducing agent; Belgian Patent No. 802,519 and Research Disclosure, RD No. 137 (September, 1975), pp. 31–32 describe a sulfonamidophenol reducing agent; and U.S. Pat. No. 4,021,240 has proposed a combination of a sulfonamidophenol reducing agent and a tetra-equivalent coupler.

Other means for formation of positive color images include a photographic silver dye bleaching process as described, for example, in *Research Disclosure,* RD No. 14433 (April, 1976), pp. 30–32 and ibid., RD No. 15227 (December, 1976), pp. 14–15 and U.S. Pat. No. 4,235,957.

In addition, European Patent Applications Nos. 76,492A and 79,056A and Japanese Patent Application (OPI) Nos. 28928/83 and 26008/83 (the term "OPI" as used herein refers to a "published unexamined Japanese patent application") disclose a method for formation of color images by heat development, using a compound essentially having a dye part and capable of releasing a movable dye corresponding to or reversely corresponding to the reduction reaction reducing exposed silver halide to silver at a high temperature.

Japanese Patent Application (OPI) Nos. 58543/83, 79247/83 and 168439/84 describe a method for transferring a movable dye which has been imagewise formed by heat development to an image receiving layer with heat as well as image receiving materials used therefor.

In said image formation method including a heating step, however, all photographic reagents which are necessary for the development of photographic materials must necessarily be preliminarily incorporated in the photographic materials, since it is impossible to obtain the necessary photographic reagents from a developer, etc., during the heat treatment.

If, however, said photographic reagents are incorporated in the photographic materials in an active state, these will react with some other components contained in the photographic materials during preservation before their intended use or will be decomposed due to heat or in the presence of oxygen, with the result that said photographic reagents do not display the desired characteristics thereof.

One method has been proposed for the purpose of solving said problem, where the active groups in the photographic reagents are blocked by certain groups to be converted into substantially inactive forms, and thus such so-called photographic reagent precursors are incorporated in the photographic materials.

In the case that dye is used as the useful photographic reagent, the functional groups of said dye, which have a great influence on the spectral absorption of the dye, are blocked, whereby the spectral absorption is shifted to the side of a short wavelength range or to the side of a long wavelength range, with the result that when the thus-shifted dyes are incorporated in a photographic emulsion layer containing a silver halide emulsion having a photosensitive spectral range which corresponds to said dye, no filtering effect occurs, and thus sensitivity decrease is prevented. This is one advantageous merit.

In the case that an antifogging agent or a development inhibitor is used as the useful photographic reagent, the functional groups thereof are blocked whereby the adsorption of said reagents to photographic silver halides as well the desensitization due to the formation of silver salts during preservation of the photographic materials may be prevented, and, at the same time, these photographic reagents are released with desired timing, with the result that the occurrence of fog may be reduced without deterioration of the sensitivity, the occurrence of fog due to exceeding development may be inhibited and the development may be stopped in the necessary period of time. This is another advantageous merit.

In the case that a developing agent, an auxiliary developing agent, or a fogging agent is used as the useful photographic reagent, the functional groups or the adsorbing groups are blocked, whereby various photographically inconvenient actions may be prevented, which will result from the formation of semiquinones or oxidized compounds by air oxidation during preservation, or the introduction of electrons into silver halides may be prevented and the occurrence of fogged nuclei during preservation may be prevented, with the result that the photographic materials may be stably processed from a practical viewpoint. This is still another advantageous merit.

In the case that a bleaching accelerator or a bleaching-fixing accelerator is used as the photographic reagent, the active groups thereof are blocked, whereby the reaction of said reagent with other components contained in the photographic material during preservation thereof may be prevented. In the actual treatment of the materials, the blocked groups are unblocked, and thus the incorporated accelerators may display the desired action thereof in the necessary period of time. This is still another advantageous merit.

Regarding the blocking technique for the photographic reagents as mentioned above, blocked conventional photographic materials have heretofore been known. For instance, various known techniques have heretofore been conventional, including utilization as a blocking group of an acyl group or a sulfonyl group, as described in Japanese Patent Publication No. 44805/72; utilization of a blocked group capable of releasing a photographic reagent by a so-called reverse Michael reaction, as described in Japanese Patent Publication Nos. 17369/79, 9696/80 and 34927/80; utilization of a blocked group capable of releasing a photographic reagent with the formation of a quinonemethide compound or an analogue thereof by intramolecular electron transfer, as described in Japanese Patent Publication No. 39727/79, Japanese Patent Application (OPI) Nos. 135944/82, 135945/82 and 136640/82; utilization of an intramolecular ring closure reaction, as described in Japanese Patent Application (OPI) No. 53330/80; or utilization of ring cleavage of a 5-membered or 6-membered ring, as described in Japanese Patent Application (OPI) Nos. 76541/82, 135949/82 and 179842/82.

However, all of these conventional techniques utilize hydrolysis or proton removal by the action of $OH^-$ in a wet development which is carried out at room temperature. Thus, no technique has yet been known which uses a precursor in a heat development treatment with an organic base.

SUMMARY OF THE INVENTION

One object of the present invention is to provide a precursor technique for a photographically useful reagent, where a compound which is stable at room temperature and which may release a photographically useful reagent only in heat development or heat transfer process is used.

Another object of the present invention is to provide a method for the formation of photographic images including a heating step, wherein said precursor technique is utilized, and to provide photographic images that are substantially free from uneven photographic characteristics even though the temperature in the heat treatment step may vary widely.

Accordingly, in the present invention, for the purpose of attaining said objects, a method is provided for the formation of a photographic image including a heating step, comprising heating a photographic material in the presence of at least one compound selected from formulae (I) and (II)

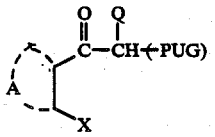

(I)

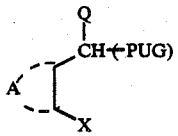

(II)

wherein

A represents a non-metallic atomic group forming a carbocyclic aromatic ring or a heterocyclic aromatic ring;

X represents a nucleophilic group or a precursor thereof;

Q represents a hydrogen atom or a substituted or unsubstituted alkyl, cycloalkyl, or aryl group; and PUG represents a photographically useful group.

DETAILED DESCRIPTION OF THE INVENTION

The present invention is explained in greater detail hereunder.

In the image formation method including a heating step, according to the present invention, a photographic material is treated with heat in the presence of at least one compound selected from formulae (I) and (II)

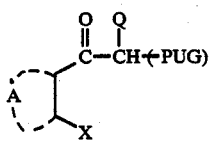

(I)

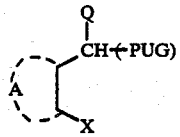

(II)

In formulae (I) and (II), A represents a nonmetallic atomic group forming a carbocyclic aromatic ring or a heterocyclic aromatic ring.

Said aromatic groups containing the group A may by either carbocyclic or heterocyclic, in particular, carbocyclic aromatic rings having from 6 to 18 carbon atoms are preferred. Examples of said carbocyclic aromatic rings include benzene, naphthalene, and anthracene.

Examples of heterocyclic aromatic rings include pyrazole, indole, pyridine, thiophene, and quinoline.

Said aromatic rings may have substituents, and examples of said substituents are a halogen atom (such as a chlorine atom, etc.), a cyano group or a substituted or unsubstituted alkyl group (such as a methyl group), an alkoxy group (such as a methoxy group), an aryl group, an alkylthio group, an arylthio group, an alkylsulfonyl group, an arylsulfonyl group, an amino group (preferably a di-substituted amino group substituted by an alkyl group or an aryl group), an acylamino group, etc.

X represents a nucleophilic group or a precursor thereof.

Examples of said nucleophilic groups include those described in *Mechanism of Homogeneous Catalysis from Protons to Proteins*, by M. L. Bender, 1971, Wiley Interscience, and in *Catalysis in Chemistry and Enzymology*, by W. P. Jencks, 1969, Mcgraw Hill.

Preferred nucleophilic groups among them are —OH, $—CH_2OH$, $—NH_2$, $—NHR^{11}$ ($R^{11}$ is defined hereinafter), $—CH_2NH_2$, $—CH_2NHR^{11}$, $—NHSO_2R^{11}$, —SH, $—CH_2SH$, $—CO_2H$, $—CONH_2$, $—CONHR^{11}$, $—SO_2NH_2$, $—SO_2NHR^{11}$, $—NHNH_2$, —NHOH, —CONHOH, $—SO_2NHOH$, $—CONHNH_2$, and $—SO_2NHNH_2$.

Examples of especially preferred nucleophilic groups among them are as follows:

Compounds of Formula (I)

—OH, —$CO_2H$, —$CH_2OH$, —$NH_2$, —$NHR^{11}$, —$SO_2NH_2$, —SH, etc.

Compounds of Formula (II)

—$CO_2H$, —$SO_2NH_2$, —$CONH_2$, —$CONHR^{11}$, —$CH_2OH$, —$CH_2NH_2$, —$CH_2NHR^{11}$, —$CONHNH_2$, —$NHNH_2$, etc.

For the compounds of formula (I) containing carbonyl group, hydrazino-containing nucleophilic groups such as —$NHNH_2$, —$CONHNH_2$, or —$SO_2NHNH_2$ are not preferred. This is because the terminal amino group in said nucleophilic group is condensed with the carbonyl group to cyclize, as shown in the following reaction scheme.

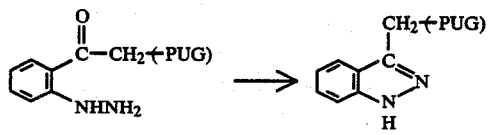

The nucleophilic group precursors are nucleophilic groups which are protected with protective groups. Preferred examples of said protective groups include those represented by formulae (A) through (C). For the protection of nucleophilic groups to form precursors thereof, two or more kinds of protective groups may exist in one compound.

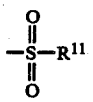

(A)

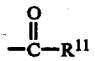

(B)

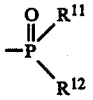

(C)

In the above formulae, $R^{11}$ and $R^{12}$ (which may be the same or different) each represents a substituted or unsubstituted alkyl, cylloalkyl, alkenyl, aralkyl, aryl, heterocyclic, alkyloxy, aryloxy, alkylthio, arylthio, or amino group, or these $R^{11}$ and $R^{12}$ may be bonded together to form a 5-membered or 6-membered ring.

Alkyl groups which are acceptable to said $R^{11}$ and $R^{12}$ are preferably linear or branched alkyl groups having from 1 to 18 carbon atoms, and examples thereof are a methyl group, an ethyl group, an n-propyl group, an n-butyl group, an n-hexyl group, an n-heptyl group, a 2-ethylhexyl group, an n-decyl group, an n-dodecyl group, etc. Cycloalkyl groups for said R's are preferably 5-membered or 6-membered cycloalkyl groups having from 5 to 10 carbon atoms, and examples thereof are a cyclopentyl group, a cyclohexyl group, etc. Examples of the substituents for the substituted alkyl or cycloalkyl groups are a halogen atom, an alkoxy group, an aryloxy group, a cyano group, an alkylthio or arylthio group, a di-substituted carbamoyl group, an alkylsulfonyl or arylsulfonyl group, a di-substituted amino group substituted by alkyl or aryl groups, a carboxyl group, a sulfo group, an acylamino group, a sulfonylamino group, etc.

Examples of alkenyl groups include a vinyl group, an allyl group, a crotyl group, a substituted or unsubstituted styryl group, etc.

Examples of aralkyl groups are a benzyl group, a β-phenyl group, etc. These alkenyl group and aralkyl group may have substituents as exemplified in the aforesaid explanation of the substituents of the substituted alkyl group.

Aryl groups are preferably those having from 6 to 18 carbon atoms, and examples thereof are a phenyl group, a naphthyl group, an anthryl group, etc. Examples of substituents for the substituted aryl groups are a substituted or unsubstituted alkyl group, a substituted or unsubstituted alkoxy group, a substituted or unsubstituted aryl group, a halogen atom, an acylamino group, a sulfonylamino group, a cyano group, a nitro group, an alkylthio or arylthio group, an alkylsulfonyl or arylsulfonyl group, an alkoxycarbonyloxy group, a substituted or unsubstituted carbamoyl group, a substituted or unsubstituted sulfamoyl group, a di-substituted amino group substituted by an alkyl or aryl group, a carboxyl group, a sulfo group, an alkylcarbonyl or arylcarbonyl group, etc.

Heterocyclic residues are preferably 5-membered or 6-membered heterocyclic residues containing hetero atoms of an oxygen atom, a nitrogen atom and/or a sulfur atom. Examples of said residues are a pyridyl group, a furyl group, a thienyl group, a pyrrolyl group, an indolyl group, etc. These heterocyclic residues may have substituents as exemplified in the aforesaid explanation of the substituents of the substituted aryl groups.

Preferred examples of an alkyloxy or aryloxy group and an alkylthio or arylthio group are represented by the following formulae (D) and (E).

—$OR^{13}$ (D)

—$SR^{14}$ (E)

In said formulae, preferred examples of $R^{13}$ and $R^{14}$ are substituted or unsubstituted alkyl groups and substituted or unsubstituted aryl groups as defined in the aforesaid description of the groups $R^{11}$ and $R^{12}$.

Amino groups are —$NH_2$ or a mono-substituted or di-substituted amino group substituted by an alkyl or aryl group(s) (such as a dimethylamino group or a diethylamino group), etc.

Q represents a hydrogen atom or a substituted or unsubstituted alkyl, cycloalkyl, or aryl group.

Preferred examples of said group Q are substituted or unsubstituted alkyl, cycloalkyl or aryl groups, as defined in the aforesaid description of the groups $R^{11}$ and $R^{12}$.

PUG represents a photographically useful group.

Examples of photographically useful reagents (PUG) which are released from precursor compounds include an antifogging agent, a development inhibitor, a developing agent, a development accelerator, an electron donor (ED), a fogging agent, a nucleus forming agent, a silver halide solvent, a bleaching accelerator, a bleaching-fixation accelerator, a fixation accelerator, a dye, a coloring material for color diffusion transfer, a coupler, a melting point lowering agent to be used in heat-sensitive materials, a coupling inhibitor to be used in diazothermophotography, etc. Examples of antifogging agents and development inhibitors are mercapto group-containing nitrogen-heterocyclic compounds. Developing agents and development accelerators include hydroquinones, catechols, aminophenols, p-phenylenediamines, pyrazolidones, ascorbic acids, etc. Electron donors, fogging agents and nucleus forming agents include α-hydroxy ketones, α-sulfonamido ketones, hydrazines, hydrazides, tetrazolium salts, aldehydes, acetylenes, quaternary salts, ylides, etc. Silver halide solvents include thioethers, rhodanines, hypo, methylenebissulfones, etc. Bleaching accelerators and bleaching-fixation accelerators include aminoethanethiols, sulfoethanethiols, aminoethanethiocarbamates, etc. Fixation accelerators include hypo. Dyes include azo dyes, azomethine dyes, anthraquinone dyes, indophenol dyes, etc.

Among the above-described photographically useful groups, development inhibitors are especially preferred, which may attain a remarkable effect when blocked in the form of formula (I) or (II). In particular, especially preferred development inhibitors among them, as being able to attain a great effect, are those of formula (III)

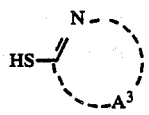

(III)

wherein $A^3$ represents an atomic group necessary for the formation of a 5-membered or 6-membered ring (preferably containing a sulfur atom, a nitrogen atom, or an oxygen atom in the ring). In formula (III), a blocking group is bonded to the sulfur or nitrogen atom.

Preferred examples of development inhibitors represented by formula (III) are the following compounds.

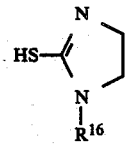

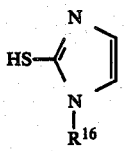

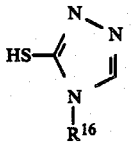

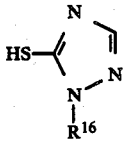

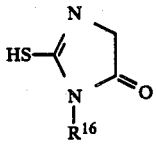

-continued

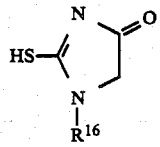

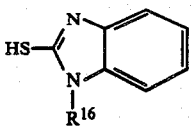

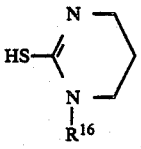

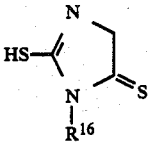

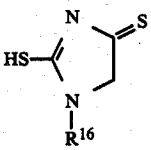

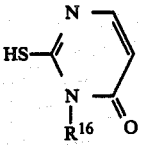

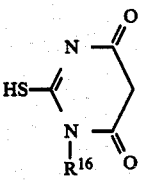

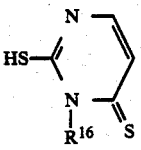

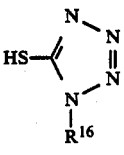

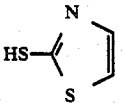

-continued

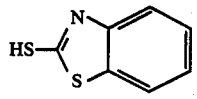

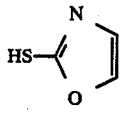

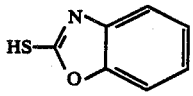

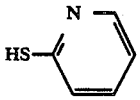

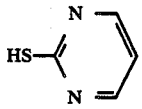

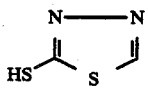

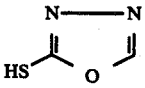

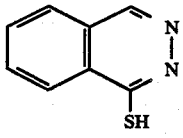

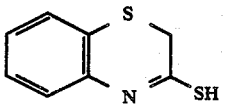

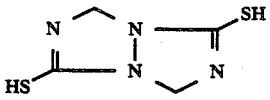

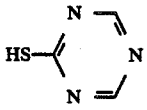

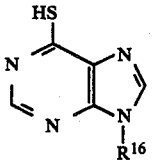

-continued

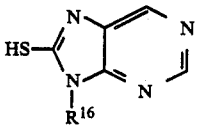

In the above formulae, $R^{16}$ represents a group selected from a hydrogen atom, an alkyl group, an aryl group, a cycloalkyl group, an alkenyl group, and an aralkyl group, which may optionally be substituted by appropriate substituents. Typical examples of said substituents are those which are acceptable for the above-described $R^{11}$.

In addition, the carbon atoms constituting the above-described rings may have substituents other than the hydrogen atom, and preferred examples of said substituents are those as described in the aforesaid description of the atomic group represented by $A^3$ in formula (III).

Other useful compounds blocked in the form of formula (I) or (II) include development inhibitors of the following formula (IV).

$$R^{17}\text{—SH} \qquad \text{(IV)}$$

wherein $R^{17}$ represents a substituted or unsubstituted alkyl, cycloalkyl, aralkyl, alkenyl, or aryl group. In formula (IV), a blocking group is bonded to the sulfur atom.

Examples of substituents in said case include an alkyl group, an aryl group, a cycloalkyl group, an aralkyl group, an alkoxy group, an aryloxy group, an alkylthio group, an arylthio group, an acyl group, an alkoxycarbonyl group, an amino group, an N-substituted amino group, an acylamino group, a carbamoyl group, an N-substituted carbamoyl group, an alkylsulfonyl group, an arylsulfonyl group, an alkylsulfonylamino group, an arylsulfonylamino group, a sulfamoyl group, an N-substituted sulfamoyl group, a cyano group, a nitro group, a halogen atom, etc.

Preferred substituents among them are an alkyl group, an alkoxy group, an aryloxy group, an alkoxycarbonyl group, an acylamino group, a sulfonylamino group, and a halogen atom.

Compounds of the following formula (IV-1) are preferred among the compounds of formula (IV).

(IV-1)

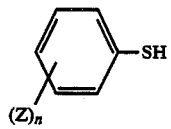

In formula (IV-1), n is an integer of from 1 to 5; and Z has the same meaning as the aforesaid symbol $R^{17}$; and when n is 2 or more, said Z's may be the same or different.

In the case that the compounds of formula (IV) have a low molecular weight, they smell bad; and in the case that the substituent $R^{17}$ in formula (IV) is more hydrophobic, then the antifogging effect of the compounds of formula (IV) may be larger. From said reasons, therefore, the compounds of formula (IV) preferably have 6 or more carbon atoms, and more preferably from 10 to 30 carbon atoms, including substituents, if any, on the group $R^{17}$.

Mercapto group-containing compounds represented by formula (III) or (IV) are known to have a development inhibiting effect when applied to silver halide photographic materials, and these may be applied to photographic materials for heat development as described in Japanese Patent Application (OPI) No. 111636/84.

If, however, the compounds of formula (III) or (IV) are initially incorporated in an emulsion layer, the development will be inhibited in the initial stage of the development, with the result that the image density formed lowers and the sensitivity also lowers. On the contrary, the compounds of formula (I) or (II) of the present invention may gradually release the development inhibitor (III) or (IV) during heat development, and therefore, the development may suitably be stopped without decrease of the image density formed.

Photographic materials for heat development or dye fixing materials having a compensatability for the temperature variation in the heat treatment may be obtained by incorporation of a compound of formula (I) or (II) of the present invention which contains the development inhibitor (III) or (IV) as blocked. In general, heat developing photographic materials are developed at a higher temperature of 80° C. or higher, and therefore, some delicate temperature variation is inevitable during the development. Under these circumstances, the developed density becomes higher in a higher temperature range, while the developed density is lower in a lower temperature range, with the result that occurrence of unevenness of the image formed is inevitable as a whole, especially in that unevenness of the fogged density in a non-image part becomes significant. In addition, the development will often proceed during the heat transfer of the movable (or diffusible) dye formed to a dye fixing material, whereby fog becomes more significant, or when the heating temperature for said heat transfer is not uniform, the transferred density becomes uneven.

If, however, the compound of formula (I) or (II) of the present invention is incorporated in a photographic material, the amount of the released development inhibitor (III) or (IV) is larger in a higher temperature range and the image density attained may suitably be inhibited, and therefore, the variation (or unevenness) of the image density formed may successfully be reduced as a whole.

In the compounds of formula (I) or (II) of the present invention, it is considered that the nucleophilic group, which has been free with heat, will act against the methylene carbon atom to which the group PUG is bonded, by intramolecular nucleophilic attack, to thereby form a ring closed product and, at the same time, to release said group PUG or a free form thereof.

Said ring closure reaction is known to be easily attained in such cases that the rings to be newly formed are 4- to 7-membered rings, especially a 5-membered ring. Accordingly, the group X in formula (I) or (II) is preferably a group capable of forming a 5-membered ring, among the above exemplified examples.

For instance, a decomposition scheme is described below in two cases wherein —X in formula (I) is —OH or —X in formula (II) is —$CO_2H$.

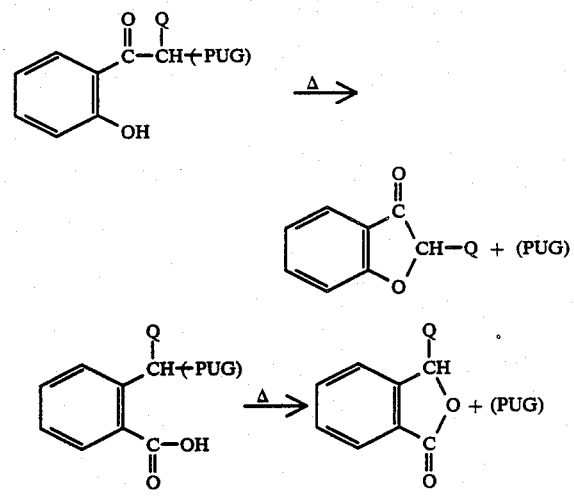

In the above cases, when —OH in the aforesaid reaction scheme is protected with any of formulae (A) through (C), it is necessary to assume that said protected group is to be attacked by any nucleophilic reagent in order to convert said protected group into a free —OH group. Such nucleophilic reagents themselves are not clarified as yet, and it is presumed that they contain a kind of terminal residue of an amino acid (e.g., —$NH_2$, —OH, —$CO_2H$, —SH,

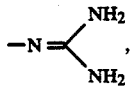

etc.), which is a constituent element of gelatin to form a binder.

It is known that the ring closure reaction by intramolecular nucleophilic attack, as shown in the aforesaid reaction scheme, generally proceeds in a solution, and therefore, it is an unexpected discovery that the same reaction may effectively be carried out in a film coated on a photographic material with little water content in a short period of time with heat.

In the case that a base or a base precursor is co-used as a development accelerator together with the compound of formula (I) or (II) of the present invention, the release of the group (PUG) may be accelerated because of the following reasons:

(i) The base released with heat may act to accelerate the dissociation of —OH, with the result that the intramolecular nucleophilic attack may be accelerated thereby.

(ii) In the case that —OH is protected, the released base may act as a nucleophilic reagent to accelerate the conversion of the protected —OH into a free —OH.

On these grounds, the co-use of a base or a base precursor together with the compound of formula (I) or (II) of the present invention is advantageous.

Preferred bases and base precursors to be co-used together with the compound of formula (I) or (II) of the present invention are, for example, as follows:

(a) Bases

Examples of preferred bases are inorganic bases such as alkali metal or alkaline earth metal hydroxides, secondary or tertiary phosphates, borates, carbonates, quinolinates or metaborates; ammonium hydroxides; quaternary alkylammonium hydroxides; and metal hydroxides; and organic bases such as aliphatic amines (e.g., trialkylamines, hydroxylamines, aliphatic polyamines), aromatic amines (e.g., N-alkyl-substituted aromatic amines, N-hydroxyalkyl-substituted aromatic amines and bis[p-(dialkylamino)phenyl]methanes), heterocyclic amines, amidines, cyclic amidines, guanidines, and cyclic guanidines, and those having a pKa value of 8 or more are especially preferred.

(b) Base Precursors

As base precursors, those capable of releasing a base through some reaction with heat are preferably used, including a salt of an organic acid and a base capable of decarboxylating and decomposing with heat or a compound capable of decomposing and releasing an amine due to intramolecular nucleophilic substitution reaction, Lossen rearrangement, Beckmann rearrangement or the like reaction. Examples of preferred base precursors are salts of trichloroacetic acid, as described in British patent No. 998,949; salts of α-sulfonylacetic acid as described in U.S. Pat. No. 4,060,420; salts of propiolic acids as described in Japanese Patent Application (OPI) No. 180573/84; 2-carboxycarboxamide derivatives as described in U.S. Pat. No. 4,088,496; salts of pyrolytic acids, in which an alkali metal or alkaline earth metal component is used besides an organic base, as a base component, as described in Japanese Patent Application No. 69597/83; hydroxamecarbamates as described in Japanese Patent Application (OPI) No. 168440/84, in which Lossen rearrangement is utilized; aldoximecarbamates capable of forming a nitrile with heat, as described in Japanese Patent Application (OPI) No. 157637/84, etc. In addition, other base precursors as described in British patent No. 998,945, U.S. Pat. No. 3,220,846, Japanese Patent Application (OPI) No. 22625/75 and British patent No. 2,079,480 are also used.

The ratio of the amounts of said components to be used may appropriately be selected, and preferably the molar ratio of said base or base precursor to the compound of formula (I) or (II) of the present invention is within the range of from 1/20 to 20/1.

Examples of the compounds of formula (I) or (II) of the present invention are set forth below, which, however, do not limit the scope of the present invention.

(1)

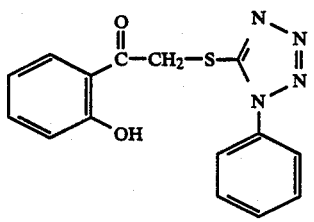

(2)

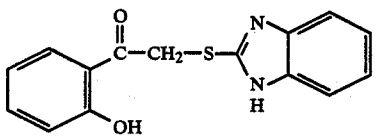

-continued (3)

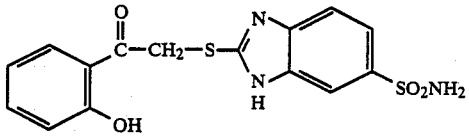

(4)

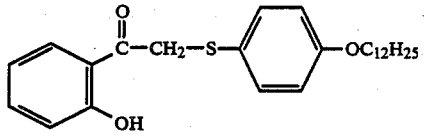

(5)

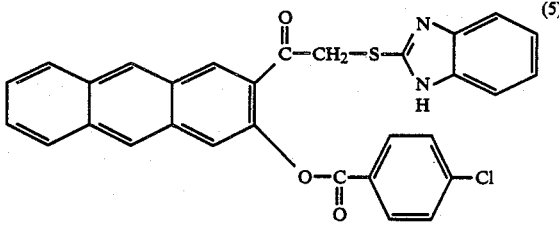

(6)

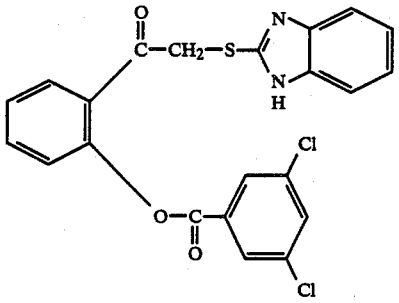

(7)

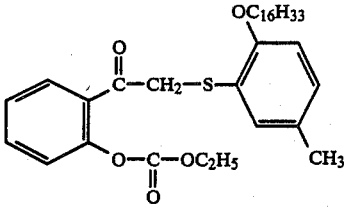

(8)

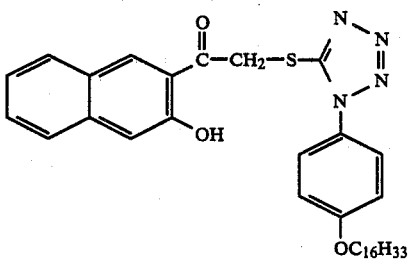

(9)

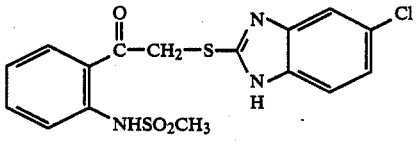

-continued
(10)
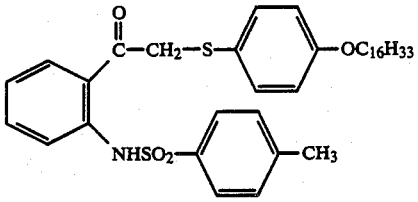
(11)
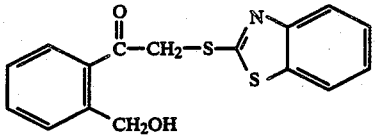
(12)
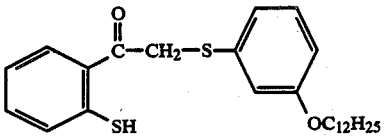
(13)
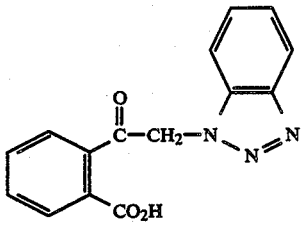
(14)
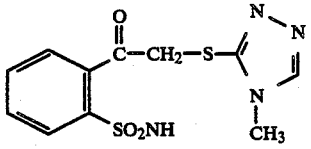
(15)
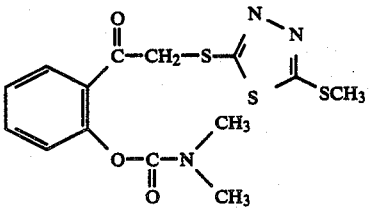
(16)
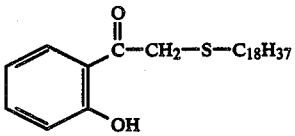
(17)
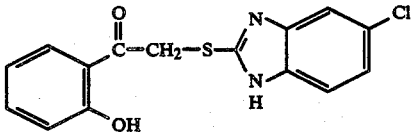
(18)
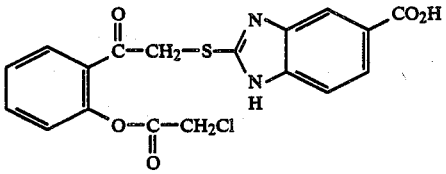
-continued
(19)
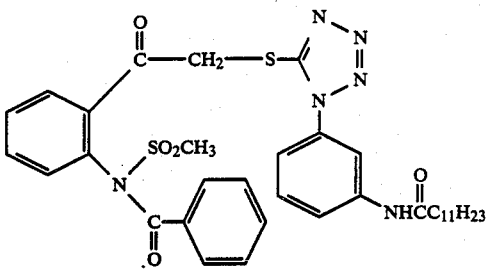
(20)
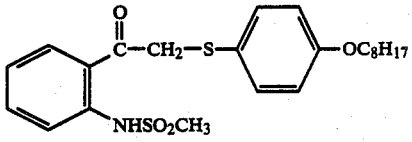
(21)
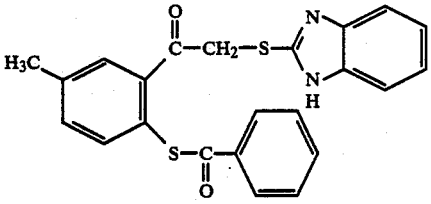
(22)
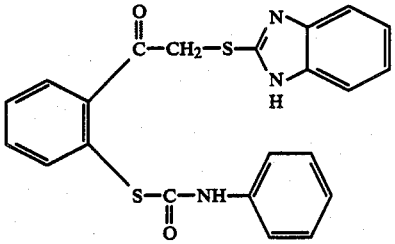
(23)
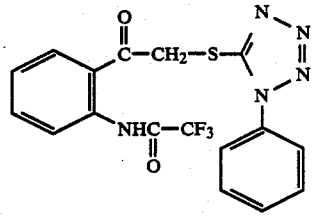
(24)
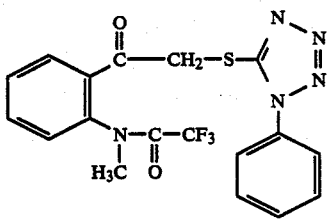
(25)
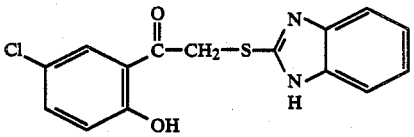

-continued
(26)
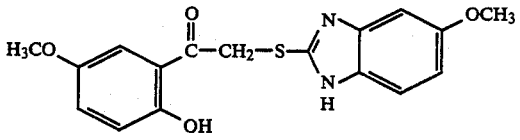
(27)
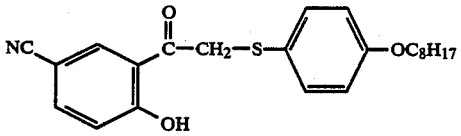
(28)
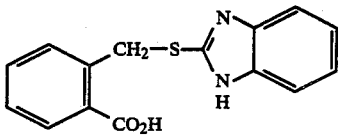
(29)
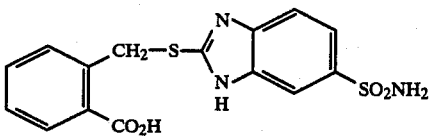
(30)
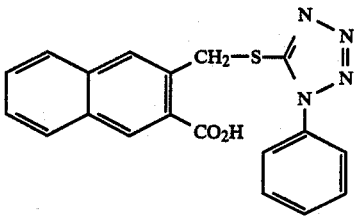
(31)
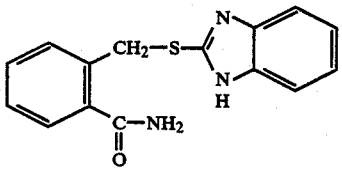
(32)
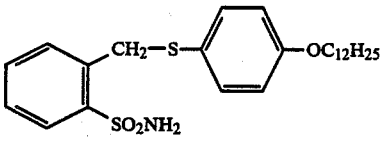
(33)
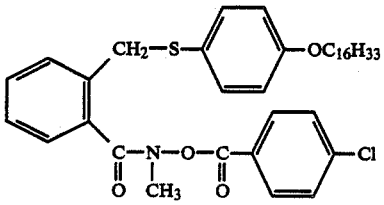
(34)
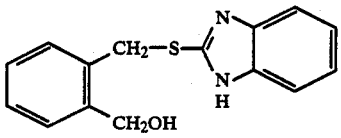
-continued
(35)
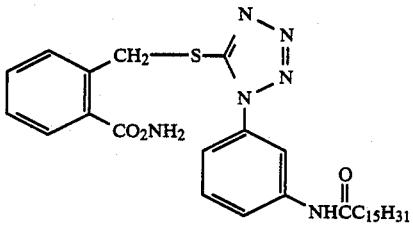
(36)
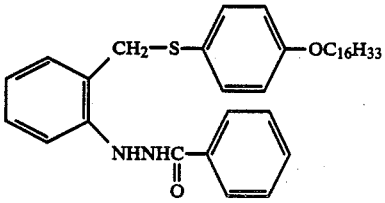
(37)
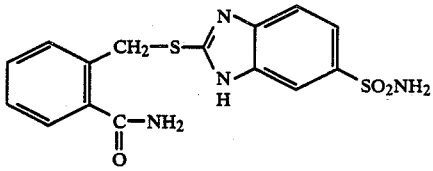
(38)
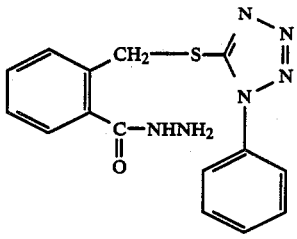
(39)
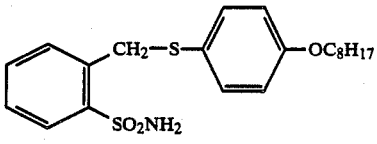
(40)
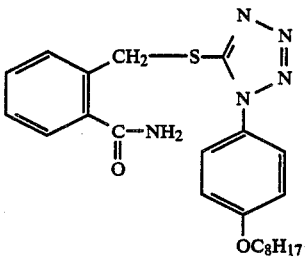
(41)
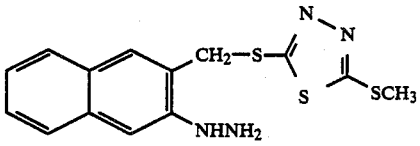
(42)
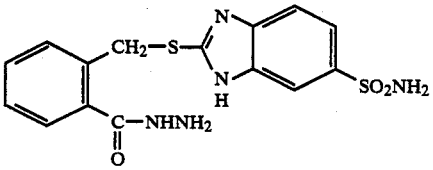

-continued
(43)
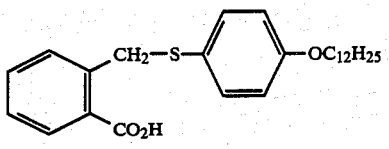
(44)
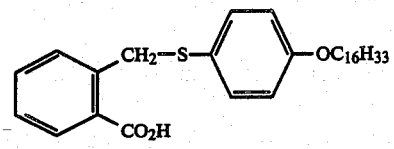
(45)
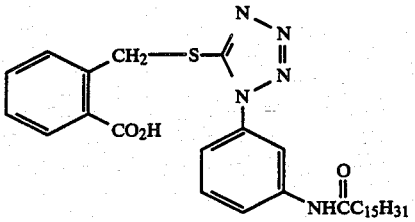
(46)
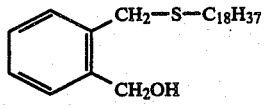
(47)
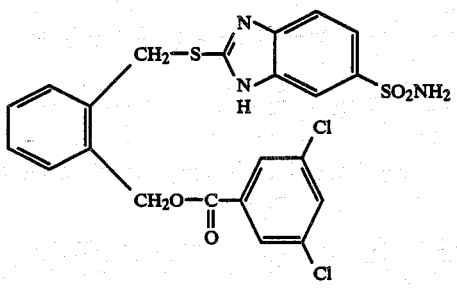
(48)
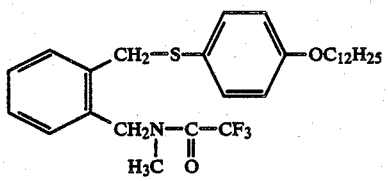
(49)
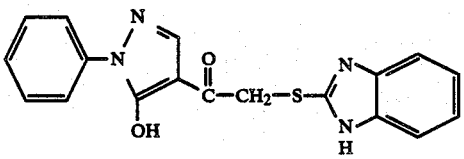
(50)
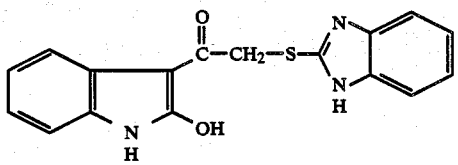
-continued
(51)
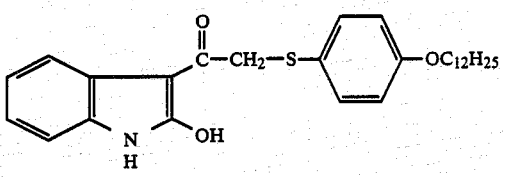
(52)
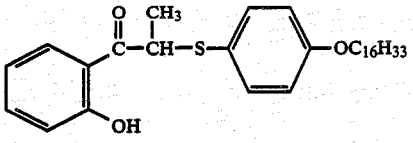
(53)
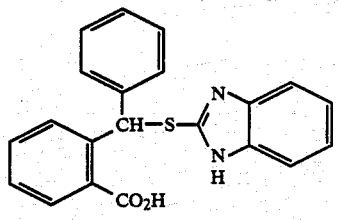
(54)
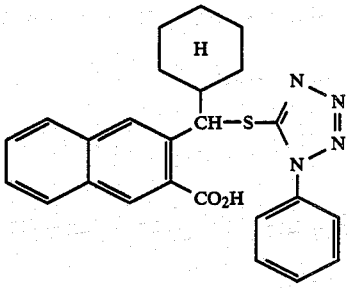
(55)
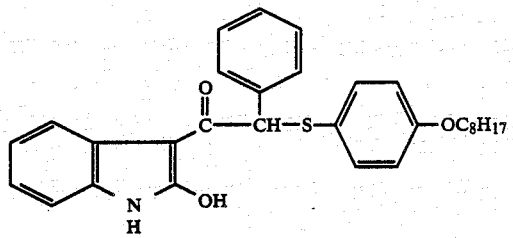
(56)
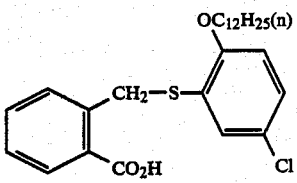
(57)
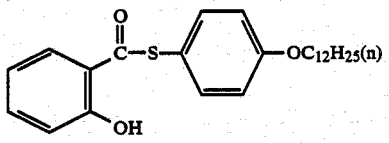
(58)
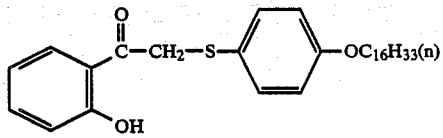

-continued

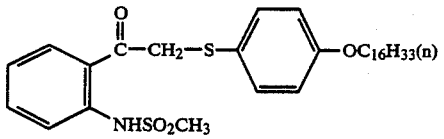

(59)

Some examples for illustrating the synthesis of the compounds of the present invention are described below.

SYNTHESIS EXAMPLE 1

Synthesis of Compound (2)

Synthesis of 2-Hydroxyphenacyl Bromide

2-Hydroxyphenacyl bromide was synthesized by brominating 2-hydroxyacetophenone with cupric bromide in accordance with the method as described in *J. Orq. Chem.*, Vol. 29, p. 3459 (1964).

Synthesis of Comoound (2)

An isopropyl alcohol solution (100 ml) containing 13.5 g (0.063 mol) of the above-obtained bromide and 9 g (0.06 mol) of 2-mercaptobenzimidazole was stirred for 1 hour under reflux. After stirring, the reaction solution was cooled to room temperature, 8.4 ml (0.06 mol) of triethylamine was added thereto, and then the resulting reaction mixture was added to 500 ml of water. A crude crystal thus crystallized out was filtered out and treated with an active charcoal and recrystallized in methanol to obtain 13.2 g (0.046 mol) of the above-mentioned Compound (2). Yield: 77%, m.p.: 155°-156° C.

SYNTHESIS EXAMPLE 2

Synthesis of Compound (28)

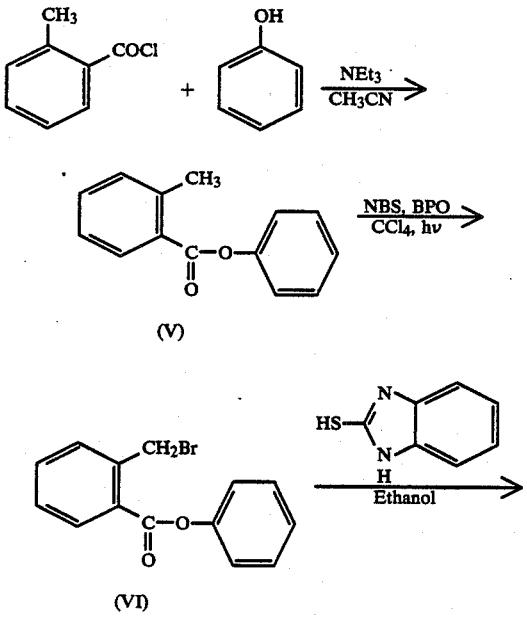

-continued

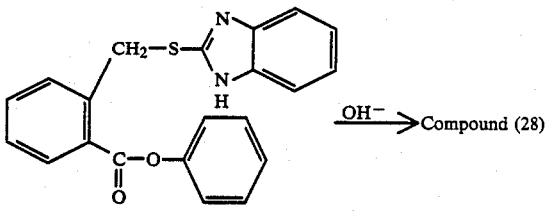

(VII)

Synthesis of Compound (VII)

400 ml of acetonitrile solution containing 47 g (0.5 mol) of phenol and 72.5 ml (0.52 mol) of triethylamine was cooled to 10° C. or lower and stirred, and 80 g (0.52 mol) of o-toluoyl chloride was added dropwise thereto while said temperature was kept as such. After the addition, the whole was stirred further for 30 minutes at room temperature, and then the reaction mixture was added to 1 liter of water and the precipitated substance was extracted out with ethyl acetate. The organic layer was dried with sodium sulfate and then concentrated to obtain oily Compound (V).

To the above-obtained oily Compound (V) were added 71.2 g (0.4 mol) of N-bromosuccinic acid imide (NBS), 0.5 g of benzoyl peroxide (BPO) and 1 liter of carbon tetrachloride, and the whole was stirred for 4 hours under reflux, while light was irradiated thereon. After stirring with irradiation, the precipitated succinic acid imide was filtered out, and the filtrate solution was concentrated. The residue was found to be an oily mixture comprising Compounds (V) and (VI) from the result of thin layer chromatography and NMR spectrum. It was confirmed therefrom that the content of Compound (VI) was about 75%.

To the above-obtained oily mixture were added 52.5 g (0.35 mol) of 2-mercaptobenzimidazole, 67.5 g (0.35 mol) of sodium methylate-28%-methanol solution and 600 ml of methanol, and the whole was stirred for 1 hour under reflux. After stirring, the resulting reaction mixture was added to 3 liters of water, and the precipitated substance was extracted with ethyl acetate. The organic layer was dried with sodium sulfate and concentrated under reduced pressure, and the residue was recrystallized in a mixture solvent of isopropyl alcohol/n-hexane (v/v =1/1), to obtain 51.4 g (0.143 mol) of Compound (VII). Yield: 41% (on the basis of 2-mercaptobenzimidazole).

Synthesis of Compound (28)

15 g (0.0417 mol) of the above-obtained Compound (VII) was added to a solution comprising 18 g (0.42 mol) of 93% sodium hydroxide, 50 ml of water and 50 m( of methanol and stirred for 8 hours at room temperature. After stirring, the resulting reaction mixture was added to 200 ml of an aqueous solution containing 40 ml of hydrochloric acid aqueous solution, and the precipitated crystal was taken out by filtration. The thus-obtained crude crystal was recrystallized in a mixture solvent comprising methanol (100 ml), ethanol (100 ml) and DMF (50 ml), to obtain 8.6 g (0.0302 mol) of the above Compound (28). Yield: 73%, m.p.: 193°-194° C.

The amount of the compound of the present invention to be used varies depending upon the kind of the compounds and the kind of the system to which the present compound is to be added and, in general, the amount of the present compound to be used is 50 wt % or less, preferably 30 wt % or less, as calculated on the basis of the weight of the layer as coated on a photographic material. The optimum amount of said compound to be used largely varies, especially depending upon the structure of the development inhibitor substance (III) or (IV) to be released. The above-mentioned development inhibitors (III) and (IV) include compounds which accelerate the development when such compounds are used in a small amount, and which inhibit the development when such compounds are used in an increased amount. On these grounds, in the case that a compound of formula (I) or (II) of the present invention which will release compound (III) or (IV) is used in the heating step of the present invention, the initial development will be accelerated and then the development in the latter stage may be inhibited, and therefore, the use of said kind of compounds is especially preferable.

The compound of the present invention may be first dissolved in a water-soluble organic solvent (such as methanol, ethanol, acetone, dimethylformamide) or in a mixture solution comprising water and said organic solvent, and the resulting solution may be incorporated in a binder.

The compound of the present invention, if being hydrophobic, may be formed into fine particles, which may be incorporated in a binder, as described in Japanese Patent Application (OPI) No. 174830/84. Said patent publication describes a method for dispersing fine particles of a base precursor into a binder, and said method is additionally suitable for stable dispersion of not only the hydrophobic compounds of the present invention but also other hydrophobic additives (especially those which are hardly soluble in organic solvents) such as acid precursors and antifogging agent precursors of the present invention into hydrophilic binders.

The compounds of the present invention may be used singly or in the form of a mixture of two or more compounds. In addition, any other development stopping agents or development stopping techniques may be co-used in the method of the present invention.

Various development stopping agents and development stopping techniques have heretofore been known, including a method of utilizing pyrolysis of aldoxime esters as described in U.S. patent application Ser. Nos. 672,643 (filed on Nov. 19, 1984) and 711,885 (filed on Mar. 14, 1985); a method of utilizing Lossen rearrangement as described in U.S. patent application Ser. No. 727,718 (filed on Apr. 26, 1985); a method of utilizing carboxylates as described in U.S. patent application Ser. No. 727,978 (filed on Apr. 26, 1 1985); etc.

In the method for the formation of photographic images including a heating step according to the present invention, said heating step may be in any stage of the image formation process, for example, this heating step may be either in development by heat, or in image transfer by heat. In addition, said heating step may be an imagewise heating step.

Photographic materials for heat development which may be used for the formation of images by heat development according to the present invention include those containing silver halides or those containing diazo compounds. The compounds of the aforesaid formulae (I) and (II) of the present invention may be added to said photographic materials, or, in the case when an image receiving layer is provided on a different support, may be added in any layer of said support. Apart from said means, the present compounds may be added later from the outside during heating.

In the method of the present invention, conventional photographic materials which are known as so-called heat developable photographic materials (for example, those as described in the aforesaid conventional techniques) are preferably used in the formation of images by heat. For instance, the compound of formula (I) or (II) may be incorporated in any layer (e.g., light-sensitive layer, intermediate layer, and protective layer) provided on a support of a heat developable photographic material, or may be added to a material for fixation of imagewise distributed movable dyes (that is, dye fixing material).

The photographic materials for heat development are most preferably those containing silver halide as a photosensitive element.

The heating temperature for said materials is suitably from about 50° C. to about 250° C., and especially preferably from 60° C. to 180° C.

Silver halides which may be used in the present invention may be formed according to the method as described in U.S. Pat. No. 4,500,626, and these may contain various additives as described in said patent application, and thus, the method of the present invention may use the silver halides having specific characteristics as described in said patent application.

The silver halide emulsions may be used without being post-ripened, but in general, these are used after chemically sensitized. The method of the present invention may use conventional type emulsions for photographic materials, which have been sensitized by conventional sulfur sensitization, reduction sensitization, noble metal sensitization or a combination thereof.

The silver halide emulsions to be used in the present invention may be either surface latent image type emulsions in which a latent image is mainly formed on the surface of the emulsion particles or internal latent image type emulsions in which a latent image is mainly formed in the internal part of the particles. In addition, direct reversal emulsions comprising a combination of said internal latent image type emulsions and nucleus forming agents may also be used in the present invention.

The amount of the photographic silver halide to be coated on a support in the present invention falls within the range of 1 mg to 10 g/m$^2$, as calculated in terms of the amount of the coated silver.

In the method of the present invention, it is preferred to co-use an organic metal salt which is relatively stable to light, especially an organic silver salt, as an oxidizing agent, together with the photographic silver halide as mentioned above.

The details of organic silver salts which may be used in the present invention are described in U.S. Pat. No. 4,500,626.

Silver halides to be used in the present invention may be spectrally sensitized with methine dyes, etc.

A detailed description of said sensitizing dyes are described in U.S. Pat. No. 4,500,626.

The photographic materials of the present invention contain a reducing agent. Regarding said reducing agents, conventional reducing agents which are known in this technical field may be used, and in particular, reducing dye forming substances as described hereinafter are preferred.

Examples of reducing agents which may be used in the present invention include those as described in U.S. Pat. No. 4,500,626.

In the method of the present invention so-called dye forming substances may be used, which form or release movable dyes when a photographic silver halide is reduced to silver at an elevated temperature, corresponding to or reversely corresponding to said reduction reaction.

Said dye forming substances are explained in further detail hereunder.

One embodiment of dye forming substances which may be used in the present invention is a coupler capable of reacting with a developing agent. In the system where said coupler is utilized, an oxidized form of a developing agent, which has been formed by oxidation reduction reaction of a silver salt and said developing agent, is reacted with said coupler to form a dye, and this system is described in a lot of literature. Examples of developing agents and couplers are described in detail, for example, in *The Theory of the Photograohic Process,* by T. H. James, 4th Ed., Macmillan Publishing Co., 1977, pp. 291–334 and pp. 354–361; and *Photographic Chemistry,* by Shinichi Kikuchi, 4th Ed., Kyoritsu Publishing, pp. 284–295; etc.

Another embodiment of said dye forming substances is a silver-dye compound comprising a combination of an organic silver salt and a dye. Examples of silver-dye compounds are described in *Research Disclosure,* RD No. 16966 (May, 1978), pp. 54–58, etc.

Still another embodiment of said dye forming substances is an azo dye which is used in a silver-dye bleaching method using heat development. Examples of said azo dyes and the bleaching process are described in U.S. Pat. No. 4,235,957 and *Research Disclosure,* RD No. 14433 (Apr., 1976), pp. 30–32, etc.

Still another embodiment of said dye forming substances is a leuco dye as described in U.S. Pat. Nos. 3,985,565 and 4,022,617.

Further embodiments of said dye forming substances are a compound having a function capable of imagewise releasing and diffusing a diffusible dye.

Said compounds are represented by formula (LI)

$$(\text{Dye}—X)_n Y \qquad \text{(LI)}$$

wherein Dye represents a dye residue or a dye precursor residue; X represents a chemical bond or a binding group; Y represents a group capable of yielding a difference of diffusibility of a compound of said formula $(\text{Dye}—X)_n Y$, corresponding to or reversely corresponding to a photographic silver salt imagewise having a latent image, or alternatively represents a group capable of releasing said Dye and yielding a difference of diffusibility between said released Dye and a compound of said formula $(\text{Dye}—X)_n Y$; n is an integer of 1 or 2; and when n is 2, the two (Dye—X)'s may be the same or different.

Various examples are disclosed in various patent specifications to illustrate said dye forming substances of formula (LI). For instance, U.S. Pat. Nos. 3,134,764, 3,362,819, 3,597,200, 3,544,545 and 3,482,972 describe color developers comprising a combination of a hydroquinone type developing agent and a dye component; Japanese Patent Application (OPI) No. 63618/76 describes such substances that may release a diffusible dye by intramolecular nucleophilic substitution reaction; and Japanese Patent Application (OPI) No. 111628/74 describes such substances that may release a diffusible dye by intramolecular rearrangement reaction of an isoxazolone ring. In all of said means, a diffusible dye is released or diffused in a non-developed part, by any dye is neither released nor diffused in a developed part.

In addition, another means is known, where a dye releasing compound is previously converted into an oxidized form having no dye releasing ability and said oxidized compound is used together with a reducing agent or a precursor thereof, and, after developed, said compound is reduced with said reducing agent, which has remained as not oxidized, to thereby release a diffusible dye from said compound. Examples of dye forming substances which may be used in said means are described, for example, in Japanese Patent Application (OPI) Nos. 110827/78, 130927/79, 164342/81 and 35533/78.

On the other hand, still other substances are known, capable of releasing a diffusible dye in a developed part. For instance, British Pat. No. 1,330,524, Japanese Patent Publication No. 39165/73 and U.S. Pat. No. 3,443,940 describe substances capable of releasing a diffusible dye by reaction of a coupler having a removable group of a diffusible dye with an oxidized form of a developing agent; and U.S. Pat. No. 3,227,550 describes substances capable of forming a diffusible dye by reaction of a coupler having a removable group of a nondiffusible group with an oxidized form of a developing agent.

However, said means using such color developing agents have a severe problem in that an image formed is often stained due to an oxidized and decomposed product of the developing agent used. In order to overcome said problem, therefore, some other dye forming compounds which themselves have a reducibility and do not require any developing agent have heretofore been proposed Typical examples of said compounds are described, for example, in the following publications: U.S. Pat. Nos. 3,928,312, 4,053,312, 4,005,428, and 4,336,322, Japanese Patent Application (OPI) Nos. 65839/84, 69839/84, 3819/78, and 104343/76, *Research Disclosure,* RD No. 17465 (Oct., 1978), U.S. Pat. Nos. 3,725,062, 3,728,113 and 3,443,939, and Japanese Patent Application (OPI) No. 116537/83. (The definitions of compounds are those as given in each publication.) These publications describe various dye forming compounds, which may be used in the present invention.

Specific examples of the dye forming substances which may be used in the present invention are compounds as described in the aforesaid Japanese Patent Application (OPI) No. 84236/84, and Compounds (1) to (3), (10) to (13), (16) to (19), (28) to (30), (33), (35), (38) to (40), and (42) to (64) described therein are preferred.

The dye forming substances or other photographic additives which may be used in the present invention may be introduced into the layers of photographic materials in a conventional manner, for example, as described in U.S. Pat. No. 2,322,027. In this case, the above-described high boiling point organic solvents or low boiling point organic solvents may be used.

In addition, a dispersion method by the use of a polymer, as described in Japanese Patent Publication No. 39853/76 and Japanese Patent Application (OPI) No. 59943/76, may also be used in the present invention. Further, various kinds of surfactants may be used for dispersion of said dye forming substance into a hydrophilic colloid.

The photographic materials of the present invention may contain an image formation accelerating agent. Image forming accelerators are those having various kinds of functions, for example, to accelerate the oxidation reduction reaction of a silver salt oxidizing agent and a reducing agent, to accelerate the formation of a dye from a dye forming substance or the decomposition of the dye formed or the release of a movable dye from a dye releasing substance, or to accelerate the transfer of the dye formed from a photographic element layer to a dye fixing element layer. From the viewpoint of the physicochemical functions of said accelerators, these may be classified into bases or base precursors, nucleophilic compounds, oils, hot melting solvents, surfactants and compounds having a mutual reactivity with silver or silver ion. In this connection, it is noted that said accelerator substances have in general composite functions and have two or more accelerating functions as mentioned above.

Details of said agents are described in U.S. Pat. No. 4,500,626.

Compounds which are effective for activation of the development of photographic materials and also for stabilization of the images formed may be used in the present invention.

The photographic materials of the present invention may optionally contain an image toning agent. Examples of effective zoning agents are described in U.S. Pat. No. 4,500,626.

The binder to be used in the photographic materials of the present invention may be a single compound or may be in the form of a mixture of plural compounds. As the binder, hydrophilic substances are preferably used. Hydrophilic binders are typically transparent or semitransparent hydrophilic binders, including, for example, natural substances such as proteins (e.g., gelatin, gelatin derivatives, cellulose derivatives, etc.) and polysaccharides (e.g., starch, gum arabic, etc.) and synthetic polymer substances such as water-soluble polyvinyl compounds (e.g., polyvinylpyrrolidone, acrylamide polymer, etc.). In addition, other synthetic polymer substances such as vinyl compounds in the form of a dispersion may be added to the photographic materials of the present invention in the form of a latex, especially for the purpose of enhancing the dimensional stability of the photographic materials.

The amount of the binder to be used in the photographic materials of the present invention is generally 20 g or less, preferably 10 g or less, more preferably 7 g or less, per $m^2$ of the material.

The ratio of the binder to a high boiling point organic solvent to be dispersed therein together with a hydrophobic compound such as a dye forming substance is 1 g of the binder to 1 cc or less, preferably 0.5 cc or less, more preferably 0.3 cc or less, of the solvent.

The photographic materials and the dye fixing materials of the present invention may contain an inorganic or organic hardener in the photographic emulsion layers or other binder layers thereof Specific examples of said additives are described in U.S. Pat. No. 4,500,626 and these compounds may be used singly or in the form of a combination of said compounds.

Supports to be used for the photographic materials and the dye fixing materials, if any, of the present invention are those which are resistant to the treatment temperature. As the general supports, glass, paper, metal and analogues thereof are used in the present invention. Various supports as described in U.S. Pat. No. 4,500,626 may also be used in the present invention.

In the case when dye forming substances capable of imagewise releasing a movable dye are used in the present invention, a dye transferring assistant agent may be used for the dye transfer of the dye formed in a photosensitive layer to a dye fixing layer.

Regarding said dye transferring assistant agents, in the case that said agent is to be added later from the outside to a photographic treatment system, water or a basic aqueous solution containing an inorganic alkali metal salt such as sodium or potassium hydroxide and an organic base may be used as the dye transferring assistant agent. For said bases, those as described in the aforesaid explanation of image formation accelerators may be used. In addition, low boiling point solvents, such as methanol, N,N-dimethylformamide, acetone or diisobutyl ketone, or mixture solutions comprising said low boiling point solvent and water or a basic aqueous solution may also be used as said dye transferring assistant agent. As the case may be, said dye transferring assistant agent may be applied to the photographic treatment system by wetting both or either of the dye fixing material and/or the photographic material, which are being photographically treated, with said assistant agent.

In the case when the photographic materials of the present invention contain colored dye forming substances, further incorporation of substances for irradiation prevention or halation prevention or other various kinds of dyes into said materials is not so necessary. If appropriate, however, filter dyes or absorptive substances may optionally be incorporated in the present photographic materials.

The photographic materials of the present invention may contain, if necessary, various additives which are known as those for heat developable photographic materials, and in addition, may also contain, if desired, other various layers than the photographic layer, such as an antistatic layer, an electroconductive layer, a protective layer, an intermediate layer, an antihalation (AH) layer, a peeling layer, etc. Various kinds of additives as described in *Research Disclosure,* RD No. 17029 (June, 1978), such as a plasticizer, a sharpness improving dye, an AH dye, a sensitizing dye, a matting agent, a surfactant, a fluorescent whitening agent, and an antidiscoloration agent, may be used.

The photographic elements of the present invention comprise a photosensitive element capable of forming or releasing a dye by heat development and optionally a dye fixing element capable of fixing the dye formed.

In particular, in such system that an image is formed by diffusion transfer of a dye formed, both the photosensitive element and the dye fixing element are essential. Said system is roughly classified into two typical embodiments, where the photosensitive element and the dye fixing element are separately provided on different two supports in one embodiment, and said two elements are provided on one support in the other embodiment.

Regarding the mutual relation between the photosensitive element and the dye fixing element, the relation between said elements and a support and the relation between said elements and a white reflective layer, the matters as described in U.S. Pat. No. 4,500,626 may be referred to in the case of the present invention.

One typical embodiment where the photosensitive element and the dye fixing element are provided on one support is such that the photosensitive element is unnecessary to be peeled off from an image receiving layer after the formation of a transferred image. In said case, a photosensitive layer, a dye fixing layer and a white reflective layer are laminated on a transparent or opaque support. Preferred embodiment of said case is described in U.S. Pat. No. 4,500,626.

Another typical embodiment as described in Japanese Patent Application (OPI) No. 67840/81, Canadian Pat. No. 674,082 and U.S. Pat. No. 3,730,718 where the photosensitive element and the dye fixing elements are provided on one support is such that a part or all of the photosensitive element is necessarily peeled off from the dye fixing element. In said case, a peeling layer is provided in an appropriate position on a support.

The photosensitive element and the dye fixing element to be used in the present invention may comprise such constitution as having an electroconductive heating element layer therein for the heating means of diffusion transfer of a dye formed.

The photosensitive element to be used in the present invention must necessarily have at least three silver halide emulsion layers each having a different photosensitivity in a different spectral range, in order to obtain dyes of a broad range in a chromaticity diagram using three primary colors of yellow, magenta and cyan.

Typical combinations of said at least three photosensitive silver halide emulsion layers each having a different photosensitivity in a different spectral range are described in U.S. Pat. No. 4,500,626.

The photographic materials of the present invention may optionally have, as the case may be, two or more emulsion layers having a photosensitivity in the same spectral range, as divided in accordance with the sensitivity of the emulsion.

Each of the above-mentioned emulsion layers and/or photoinsensitive hydrophilic colloid layers to be provided on a support as being adjacent to each of said emulsion layers necessarily contain at least one substance as described in U.S. Pat. No. 4,500,626.

The photographic materials of the present invention may have, in addition to the above-mentioned layers, a protective layer, an intermediate layer, an antistatic layer, an anti-curl layer, a peeling layer, a matting layer, or other auxiliary layers, if desired.

In particular, the protective layer generally contains an organic or inorganic matting agent for the purpose of prevention of surface blocking. In addition, said protective layer may further contain a mordanting agent, a UV-absorbent, etc. The protective layer and the intermediate layer each may comprise two or more layers.

The intermediate layer may contain a reducing agent, a UV-absorbent and a white pigment such as $TiO_2$, for the purpose of prevention of color stain. Said white pigment may further be added not only to an intermediate layer, but also to emulsion layers, for the purpose of increasing the sensitivity of the emulsions.

The dye fixing element to be used in the present invention contains at least one layer having a mordanting agent, and in the case when said dye fixing element layer is positioned on the outermost surface of the element, any further protective layer may be superposed thereon, if desired.

Regarding the layer constitution of the dye fixing elment, the binder, the additives, the position and the addition of the mordanting agent, etc., the relevant technical contents as described in U.S. Pat. No. 4,500,626 may also be applied to the present invention.

The dye fixing element which may be used in the present invention may optionally contain, if desired, a peeling layer, a matting agent layer, an anti-curl layer, or other auxiliary layers, in addition to the aforesaid layers.

One or plural layers of the aforesaid layers may further contain a base and/or a base precursor for acceleration of dye transfer, a hydrophilic hot melting solvent, a discoloration preventing agent for prevention of color stain or discoloration, a UV-absorbent, a dispersed vinyl compound for increase of dimensional stability, a fluorescent whitening agent, etc.

The binder to be contained in the aforesaid layers is preferably hydrophilic, and transparent or semitransparent hydrophilic colloids are typical. The binders as described in the aforesaid explanation of the photographic materials may also be used as the binders for the present dye fixing element layers.

In addition, the dye fixing element of the present invention advantageously contains a transfer assistant agent as described hereinafter. The transfer assistant agent may be incorporated in the dye fixing layer, or alternatively, in any other layer in said dye fixing element.

For the provision of a heating element in the materials of the present invention, two means may be utilized, including a method where a thin film of a semiconductive inorganic material is used and a method where an organic thin film formed by dispersing electroconductive fine particles in a binder is used. Materials which may be used in said means are described in U.S. Pat. No. 4,500,626, and these may be utilized in the present invention in accordance with the direction and the layer constitution as illustrated in U.S. Pat. No. 4,500,626. Regarding the mutual relation of the positions between the heating element and the photosensitive element, the technical contents as described in U.S. Pat. No. 4,500,626 may be applied to the case of the present invention.

The image receiving layer used in the present invention includes the dye fixing layer which is generally used in color photographic materials for heat development, and this may contain a mordanting agent freely selected from conventional agents. In particular, a polymer mordanting agent is especially preferred among them. Said polymer mordanting agents include, for example, a tertiary amino-containing polymer, a polymer having a nitrogen-containing heterocyclic ring part and quaternary cation-containing polymers thereof.

The technical means as described in U.S. Pat. No. 4,500,626 may be applied to the method for the coating of heat developing photographic layers, protective layers, intermediate layers, subbing layers, backing layers, and other layers in the present invention.

Radiation, including visible rays, may be used as a light source for the image exposure for the formation of recording of images on the heat developable photographic materials of the present invention. For example, various light sources as described in U.S. Pat. No. 4,500,626 may be used.

The heating temperature in the heat development step is possibly within the range of from about 80° C. to about 250° C., and especially preferably within the range of from about 110° C. to about 180° C. The heating temperature in the transfer step is possibly within the range of from the temperature in the heat development step to room temperature, and is especially preferably up to the temperature lower than the temperature in the heat development step by about 10° C. As the heating means in the development and/or transfer steps, various heating means may be utilized, including a mere hot plate, an iron, a hot roller, or a heating element containing carbon or titanium white.

The development and the transfer may be carried out simultaneously or continuously in the method of the present invention, in the same manner as described in Japanese Patent Application (OPI) No. 218443/84 in detail. In these processes, the aforesaid image formation accelerator and/or dye transferring assistant agent may previously be incorporated in both or either the dye fixing material and/or the photosensitive material, or alternatively, said agents may be added thereto later from the outside. In said system where the development and the transfer are carried out simultaneously or continuously, the heating temperature is preferably 60° C. or higher but is preferably lower than the boiling point of the solvent used for the transfer. For instance, in the case when water is used as the transfer solvent, the heating temperature is desirably from 60° C. to 100° C.

The dye transferring assistant agent (such as water) is applied between the photosensitive layer of a heat developable photographic material and the dye fixing layer of a dye fixing material, to thereby accelerate the transfer of the dye formed from the photosensitive layer to the dye fixing layer. If appropriate, the dye transferring assistant agent may be preliminarily added to either or both of the photosensitive layer and the dye fixing layer, and then the two layers may be attached to each other.

Regarding the means for the application of said dye transferring assistant agent to a photosensitive layer or to a dye fixing layer, for example, a method as described in U.S. Pat. No. 4,500,626 may be used.

Regarding the heating means in a transfer step, for example, a means as described in U.S. Pat. No. 4,500,626 may be used. Apart from said means, some other means may also be utilized in the method of the present invention, where a layer of an electroconductive material such as a graphite, carbon black or metal is previously laminated in the dye fixing material, and an electric charge is imparted to said electroconductive layer to thereby directly heat said dye fixing material.

The heating temperature in said transfer process may possibly fall within the range from the temperature in the heat development step to room temperature, and is preferably 60° C. or more, up to a temperature lower than that in the heat development temperature by 10° C. or more.

Regarding the pressure condition or the means therefor for closely sticking the heat developing photographic material and the dye fixing material to each other, the method as described in U.S. Pat. No. 4,500,626 may be used.

According to the method of the present invention, as explained in detail in the above explanation, the photographic material, is optionally together with a dye fixing material, heated in the presence of at least one compound selected from the compounds of aforesaid formulae(I) and (II), and, therefore, the photographic images formed are substantially free from any uneven photographic characteristics even if the heating temperature during the heating treatment is fairly varied. This is an advantage of the image formation method of the present invention including said characteristic heating step.

Said merit or effect essentially results from the use of said compounds of formulae (I) and (II), which are stable at room temperature and have a capability of releasing a photographically useful reagent only in the heat development or heat transfer step.

The present invention is now explained in greater detail by reference to the following examples, which, however, are not intended to limit the scope of the present invention.

EXAMPLE 1

A silver bromoiodide emulsion was prepared as follows:

40 g of gelatin and 26 g of KBr were dissolved in 3,000 ml of water. The resulting solution was stirred while being kept at 50° C.

Next, a solution of 34% of silver nitrate dissolved in 200 ml of water was added to the above solution over the course of 10 minutes.

Afterwards, a solution of 3.3 g of KI as dissolved in 100 ml of water was added thereto over the course of 2 minutes.

The pH value of the thus formed silver bromoiodide emulsion was properly adjusted and sedimented to remove the excess salts therefrom.

Next, the pH value of the emulsion was adjusted to 6.0, to obtain 400 g of the desired silver bromoiodide emulsion.

A gelatin dispersion of a dye forming substance was prepared as follows:

5 g of Yellow Dye Forming Substance (1) (see below), 0.5 g of 2-ethylhexyl succinate/sodium sulfate (as surfactant) and 10 g of triisononyl phosphate were weighed, and 30 ml of ethyl acetate was added thereto and dissolved by heat at about 60° C. to obtain a uniform solution. This solution was admixed with 100 g of a 10% lime-treated gelatin solution, as being stirred, and then the resulting mixture was dispersed in a homogenizer for 10 minutes (10,000 rpm). The dispersion obtained was yellow dye forming substance dispersion.

In the same manner as above with the exception that Magenta Dye Forming Substance (2) (see below) was used, a magenta dye forming substance dispersion was formed. Also, in the same manner, a cyan dye forming substance dispersion containing Cyan Dye Forming Substance (3) (see below) was formed.

(1)

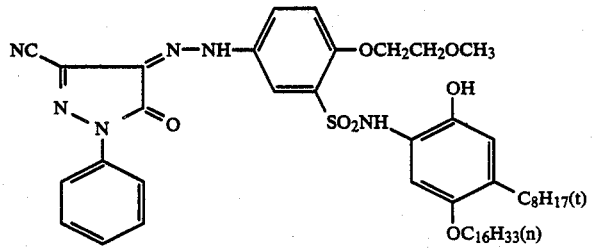

-continued

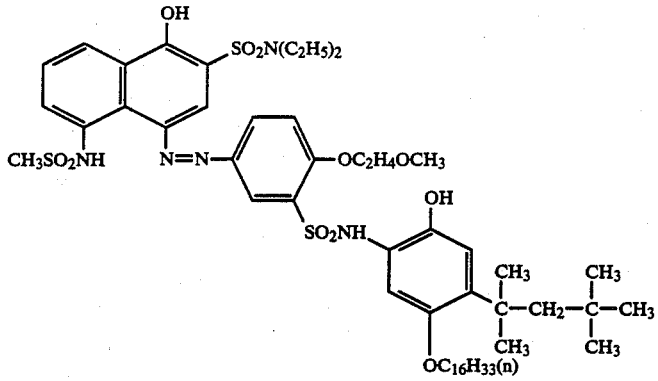

(2)

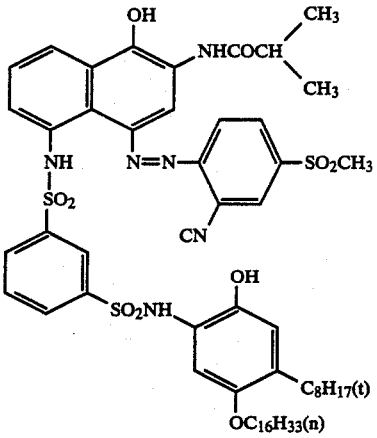

(3)

A gelatin dispersion containing a compound of the aforesaid formula (I) or (II) of the present invention was prepared as follows:

3 g of Compound (2) of the present invention (listed hereinbefore) was added to 100 g of a 1% gelatin aqueous solution and milled with 100 g of glass beads having an average grain size of about 0.6 mm for 10 minutes. The glass beads used was separated out by filtration to obtain a gelatin dispersion containing the present Compound (2).

Using these, Color Photographic Material (A) comprising multilayer constitution as shown in the following was formed.

Photographic Material (A)

6th Layer: Gelatin (coated amount: 1,000 mg/m$^2$), Base precursor*3 (coated amount: 220 mg/m$^2$), Compound (2) (coated amount: 10 mg/m$^2$)

5th Layer: Blue-Sensitive Emulsion Layer
- Silver bromoiodide (iodide 10 mol %, coated amount 400 mg (silver)/m$^2$),
- Compound*4 (coated amount: 180 mg/m$^2$),
- Base precursor*3 (coated amount: 520 mg/m$^2$)
- Compound (2) (coated amount: 5 mg/m$^2$),
- Yellow Dye Forming Substance (1) (coated amount 400 mg/m$^2$),
- Gelatin (coated amount: 1,000 mg/m$^2$),
- High boiling point solvent *1 (coated amount: 800 mg/m$^2$),
- Surfactant*2 (coated amount: 100 mg/m$^2$)

4th Layer Intermediate Layer
- Gelatin (coated amount: 1,200 mg/m$^2$),
- Base precursor*3 (coated amount: 220 mg/m$^2$),
- Compound (2) (coated amount: 10 mg/m$^2$)

3rd Layer: Green-Sensitive Emulsion Layer
- Silver bromoiodide emulsion (iodide 10 mol %, coated amount: 400 mg (silver)/m$^2$),
- Compound*4 (coated amount: 180 mg/m$^2$),
- Sensitizing Dye (D-1) (coated amount: $10^{-6}$ mol/m$^2$),
- Base precursor*3 (coated amount: 515 mg/m$^2$),
- Compound (2) (coated amount: 5 mg/m$^2$),
- Magenta Dye Forming Substance (2) (coated amount: 400 mg/m$^2$),
- Gelatin (coated amount: 1,000 mg/m$^2$),
- High boiling point solvent (coated amount: 800 mg/m$^2$),
- Surfactant*2 (coated amount: 100 mg/m$^2$)

2nd Layer Intermediate Layer
- Gelatin (coated amount: 1,000 mg/m$^2$),
- Base precursor*3 (coated amount 230 mg/m$^2$),
- Compound (2) (coated amount: 10 mg/m$^2$)

1st Layer: Red-Sensitive Emulsion Layer
- Silver bromoiodide emulsion (iodide 10 mol %, coated amount: 400 g (silver)/m$^2$),
- Compound*4 (coated amount: 180 mg/m$^2$),
- Sensitizing Dye (D-2) (coated amount: $8\times10^{-7}$ mol/m$^2$),
- Base precursor*3 (coated amount: 515 mg/m$^2$),
- Compound (2) (coated amount: 5 mg/m$^2$),
- Cyan Dye Forming Substance (3) (coated amount: 300 mg/m$^2$),
- Gelatin (coated amount: 1,000 mg/m$^2$),
- High poiling point solvent*1 (coated amount: 600 mg/m$^2$),
- Surfactant*2 (coated amount: 100 mg/m$^2$)

Support

*1: $(iso\text{-}C_9H_{19}O)_3P{=}O$

*2: $C_9H_{19}$— 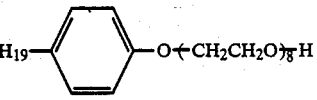 —$O(CH_2CH_2O)_{18}H$

*3: $CH_3CONH$— 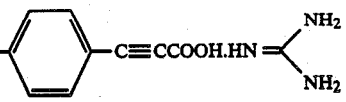 —$C{\equiv}CCOOH.HN{=}C(NH_2)_2$

*4*

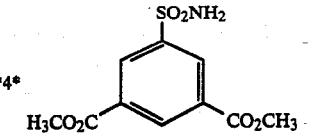

(D-1)

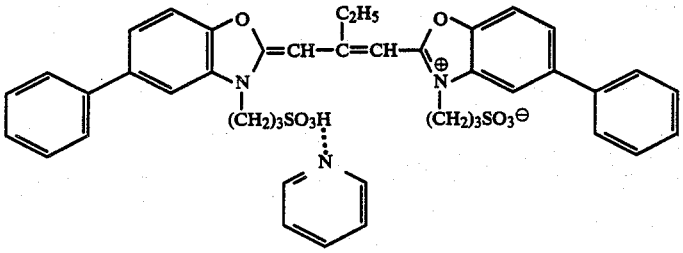

(D-2)

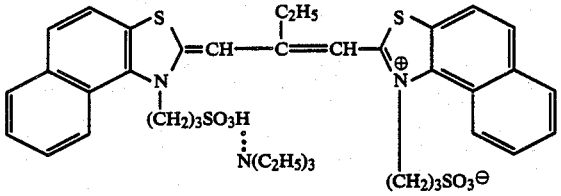

In the same manner as in the above Photographic Material (A) with the exception that Compounds (4) and (29), respectively, were used instead of Compound (2), other Photographic Materials (B) and (C) were formed. In comparison, Comparative Photographic Material (D) which did not contain the compound of the present invention of formula (I) or (II) was analogously formed.

Next, a dye fixing material having an image receiving layer was fomred as follows:

First, 0.75 g of Gelatin Hardener (H-1) (see below), 0.25 g of Gelatin Hardener (H-2) (see below), 160 ml of water and 100 g of 10% lime treated gelatin were uniformly blended. The resulting mixture was uniformly coated on a paper support laminated with a polyethylene film containing titanium oxide dispersion to form a layer having a wet film thickness of 60 μm and then dried.

Gelatin Hardener (H-1)

$CH_2{=}CHSO_2CH_2CONHCH_2CH_2NHCOCH_2SO_2CH{=}CH_2$

Gelatin Hardener (H-2)

$CH_2{=}CHSO_2CH_2CONHCH_2CH_2CH_2NHCOCH_2SO_2CH{=}CH_2$

Next, 15 g of a polymer having the following constitution was dissolved in 200 ml of water and the resulting solution was uniformly blended with 100 g of 10% lime-treated gelatin. The mixture solution formed was uniformly coated on the above-formed layer to form a layer having a wet film thickness of 85 μm. The thus-formed sample was dried to obtain the desired dye fixing material.

Polymer

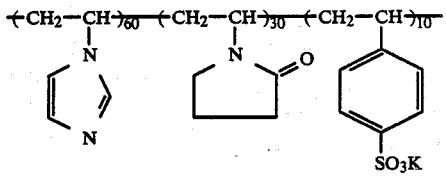

Limiting viscosity: 0.3473 as measured in 1/20 M-$Na_2HPO_4$ aqueous solution at 30° C.

The ratio of each repeating unit is based on molar ratio.

The color photographic material of multilayer constitution as obtained above was exposed to a tungsten lamp at 2,000 lux for 10 seconds through a blue-green-red (B-G-R) three color separation filter in which each color density continuously varies, and then uniformly heated on a heat block heated at 150° C. or 153° C. for 20 seconds.

The above-obtained image receiving material was dipped in water, and then each of the above-heated Photographic Materials (A) through (D) was attached thereto so that the both surfaces of the coated films of the coated materials faced each other.

The thus-adhered materials were heated on a heat block at 80° C. for 6 seconds, and then the image receiving material was peeled off from the photographic material, whereby a negative magenta image was formed on the image receiving material. The density of each of the negative images formed was measured with Macbeth reflection densitometer (RD-519).

The results are given in the following Table 1.

TABLE 1

| Sample | Compound of the Present Invention | Filter | Heated for 20 Sec. at 150° C. Maximum Density | Heated for 20 Sec. at 150° C. Minimum Density | Heated for 20 Sec. at 153° C. Maximum Density | Heated for 20 Sec. at 153° C. Minimum Density |
|---|---|---|---|---|---|---|
| (A) (Invention) | (1) | B | 1.95 | 0.17 | 2.00 | 0.19 |
| | | G | 2.03 | 0.17 | 2.08 | 0.20 |
| | | R | 2.10 | 0.16 | 2.12 | 0.19 |
| (B) (Invention) | (2) | B | 1.94 | 0.16 | 1.98 | 0.20 |
| | | G | 2.00 | 0.18 | 2.05 | 0.22 |
| | | R | 2.09 | 0.16 | 2.14 | 0.19 |
| (C) (Invention) | (3) | B | 1.90 | 0.15 | 1.97 | 0.17 |
| | | G | 2.02 | 0.17 | 2.05 | 0.20 |
| | | R | 2.05 | 0.16 | 2.08 | 0.18 |
| (D) (Comparison) | None | B | 1.95 | 0.18 | 2.07 | 0.31 |
| | | G | 2.04 | 0.20 | 2.21 | 0.38 |
| | | R | 2.12 | 0.17 | 2.28 | 0.29 |

The above results show the following facts. In the samples using the compound of the present invention, no substantial increase in either the maximum density or the minimum density occurred even though the development temperature was elevated higher by 3° C. On the other hand, in the comparative sample, which did not contain the compound of the present invention, an extreme increment in the fog (minimum density) was noticed. Accordingly, it is noted that the compounds of the aforesaid formulae (I) and (II) of the present invention have a high temperature compensatory effect.

EXAMPLE 2

A silver halide emulsion for the 5th layer was prepared as follows:

1,000 ml of an aqueous solution containing potassium iodide and potassium bromide and a silver nitrate solution (containing 1 mol of silver nitrate as dissolved in 1,000 ml of water) were simultaneously added to a well stirred gelatin aqueous solution (containing 20 g of gelatin and ammonia as dissolved in 1,000 cc of water and warmed at 50° C.), while the pAg value of the resulting solution was kept constant. Thus, a monodispersed octahedral silver bromoiodide emulsion (iodine content: 5 mol %) having an average grain size of 0.5 μm was obtained.

After being washed with water and demineralized 5 mg of chloroauric acid tetrahydrate and 2 mg of sodium thiosulfate were added to the emulsion obtained and heated at 60° C. for gold sensitization and sulfur sensitization. The yield of the emulsion was 1.0 kg.

Next, an emulsion for the 3rd layer was prepared as follows:

600 ml of an aqueous solution containing sodium chloride and potassium bromide, a silver nitrate solution (containing 0.59 mol of silver nitrate as dissolved in 600 ml of water) and the following Dye Solution (I) were simultaneously added to a well stirred gelatin aqueous solution (containing 20 g of gelatin and 3 g of sodium chloride as dissolved in 1,000 ml of water and warmed at 75° C.), in the course of 40 minutes, at the same dropwise addition rate. Thus, a mono-dispersed cubic silver bromochloride emulsion (bromine content: 80 mol %) having an average grain size of 0.35 μm, to which the dye (given below) was adsorbed, was obtained.

After being washed with water and demineralized, 5 mg of sodium thiosulfate and 20 mg of 4-hydroxy-6-methyl-1,3,3a,7-tetraazaindene were added to the emulsion obtained and heated at 60° C. for chemical sensitization thereof. The yield of the emulsion was 600 g.

Dye Solution (I):

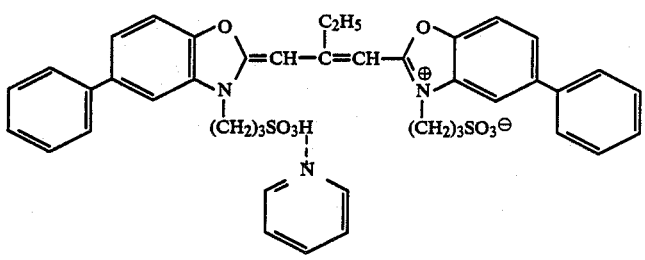

160 ml

Methanol 400 ml

Next, an emulsion for the 1st layer was prepared as follows:

600 ml of an aqueous solution containing sodium chloride and potassium bromide and a silver nitrate solution (containing 0.59 mol of silver nitrate as dissolved in 600 ml of water) were simultaneously added to a well stirred gelatin aqueous solution (containing 20 g of gelatin and 3 g of sodium chloride as dissolved in 1,000 ml of water and warmed at 75° C.), in the course of 40 minutes, at the same dropwise addition rate. Thus, a monodispersed cubic silver bromochloride emulsion (bromine content: 80 mol %) having an average grain size of 0.35 μm was obtained.

After being washed with water and demineralized, 5 mg of sodium thiosulfate and 20 mg of 4-hydroxy-6-methyl- 1,3,3a,7-tetraazaindene were added to the emulsion obtained and heated at 60° C. for chemical sensitization thereof. The yield of the emulsion was 600 g.

Next, a silver benzotriazole emulsion was prepared as follows:

28 g of gelatin and 13.2 g of benzotriazole were dissolved in 3,000 ml of water. The solution formed was kept at 40° C. and stirred. A solution of 17 g of silver nitrate dissolved in 100 ml of water was added to said solution over the course of 2 minutes.

The pH value of this silver benzotriazole emulsion was regulated and sedimented to remove the excess salts therefrom. Afterwards, the pH value thereof was adjusted to 6.0, to obtain 400 g of the desired silver benzotriazole emulsion.

A dispersion of a dye forming substance was prepared in the same manner as in Example 1.

Using these, Color Photographic Material (E) comprising a multilayer constitution as shown in the following was formed.

Photographic Material (E)

6th Layer: Gelatin (coated amount: 740 mg/m$^2$), Base Precursor (A)*3 (coated amount: 250 mg/m$^2$)

5th Layer: Blue-Sensitive Emulsion Layer
- Silver bromoiodide emulsion (iodide 5 mol %, coated amount: 500 mg (silver)/m$^2$),
- Benzenesulfamide (coated amount: 160 mg/m$^2$),
- Base Precursor (A)*3 (coated amount: 270 mg/m$^2$),
- Silver benzotriazole emulsion (coated amount: 300 mg (silver)/m$^2$),
- Yellow Dye Forming Substance (1) (coated amount: 400 mg/m$^2$),
- Gelatin (coated amount: 1,200 mg/m$^2$),
- High boiling point solvent*1 (coated amount: 700 mg/m$^2$), Surfactant*2 (coated amount: 70 mg/m$^2$)

4th Layer: Intermediate Layer
- Gelatin (coated amount: 700 mg/m$^2$),
- Base Precursor (A)*3 (coated amount: 240 mg/m$^2$)

3rd Layer: Green-Sensitive Emulsion Layer
- Silver bromochloride emulsion (bromide 80 mol %, coated amount: 200 g (silver)/m$^2$),
- Benzenesulfamide (coated amount: 140 mg/m$^2$),
- Silver benzotriazole emulsion (coated amount: 100 g (silver)/m$^2$),
- Base Precursor (A)*3 (coated amount: 210 mg/m$^2$)
- Magenta Dye Forming Substance (2) (coated amount: 330 mg/m$^2$),
- Gelatin (coated amount: 860 mg/m$^2$),
- High boiling point solvent*1 (coated amount: 430 mg/m$^2$),
- Surfactant*2 (coated amount 60 mg/m$^2$)

2nd Layer: Intermediate Layer
- Gelatin (coated amount: 1,000 mg/m$^2$),
- Base Precursor (A)*3 (coated amount: 240 mg/m$^2$)

1st Layer: Red-Sensitive Emulsion Layer
- Silver bromochloride emulsion (bromide 80 mol %, coated amount: 200 mg (silver)/m$^2$),
- Benzenesulfamide (coated amount: 140 mg/m$^2$),
- Sensitizing dye*4 (coated amount: $8\times10^{-7}$ mol/m$^2$),
- Silver benzotriazole emulsion (coated amount: 230 mg/m$^2$),
- Base Precursor (A)*3 (coated amount: 230 mg/m$^2$),
- Cyan Dye Forming Substance (3) (coated amount: 300 mg/m$^2$),
- Gelatin (coated amount: 850 mg/m$^2$),
- High boiling point solvent*1 (coated amount: 540 mg/m$^2$),
- Surfactant*2 (coated amount: 60 mg/m$^2$)

Support

*1: $(iso\text{-}C_9H_{19}O)_3P{=}O$

*2: 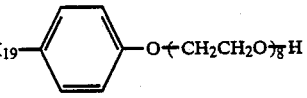

*3: 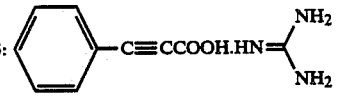

*4: 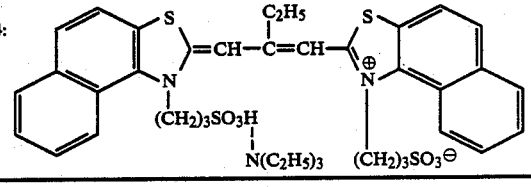

Next, a dye fixing material was prepared as follows:

12 g of a lime-treated gelatin was dissolved in 200 ml of water, and 16 ml of a 0.5 M zinc acetate aqueous solution was added thereto and blended uniformly. The resulting mixture solution was uniformly coated on a white film support (thickness: 100 μm) made of a titanium oxide-containing polyethylene terephthalate to form a coated film having a wet film thickness of 85 μm. Next, a coating solution comprising the following composition was uniformly coated on said coated film to form a supercoated film having a wet film thickness of 90 μm, and dried to obtain the desired dye fixing material.

| Composition of the Coating Solution for Dye Fixing Layer (F): | |
|---|---|
| Polyvinyl Alcohol (polymerization degree: 2,000), 10% Aqueous Solution | 120 g |
| Urea | 20 g |
| N—Methylurea | 20 g |
| 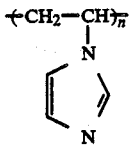 (12% aqueous solution) | 80 g |
| (limiting viscosity: 0.1726 as measured in 1% NaCl aqueous solution at 30° C.) | |
| Compound (2) of the Present Invention (as used in Example 1) | 60 ml |

| Composition of the Coating Solution for Dye Fixing Layer (G): | |
|---|---|
| Polyvinyl Alcohol (polymerization degree: 2,000), 10% Aqueous Solution | 120 g |
| Urea | 20 g |
| N—Methylurea | 20 g |
| 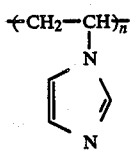 (12% aqueous solution) | 80 g |
| (the same compound as used in Dye | |

-continued

| Composition of the Coating Solution for Dye Fixing Layer (G): | |
|---|---|
| Fixing Layer (F)) | |
| Water | 60 ml |

The color photographic material of multilayer constitution as obtained above was exposed to a tungsten lamp at 2,000 lux for 1 second through a B-G-R three color separation filter in which each color density continuously varies, and then uniformly heated on a heat block heated at 150° C. for 20 seconds.

Said photographic material was adhered to the previously formed dye fixing material so that both surfaces of the coated films of the coated materials faced each other, and passed through heat rollers of 130° C. under pressure, and then immediately heated on a heat block at 120° C. for 30 seconds. Immediately after heating, the dye fixing material was peeled off from tne photographic material, whereby yellow, magenta and cyan color images were formed on the dye fixing material, corresponding to the B-G-R three color separation filter, respectively. The maximum density and the minimum density of each color image were measured with Macbeth reflection densitometer (RD-519). The results are set forth in Table 2 below.

TABLE 2

| Color Separation Filter | Dye Fixing Layer (F) was used. (present sample) Maximum Density | Minimum Density | Dye Fixing Layer (G) was used. (comparative sample) Maximum Density | Minimum Density |
|---|---|---|---|---|
| B | 1.88 | 0.19 | 1.90 | 0.28 |
| G | 2.09 | 0.20 | 2.12 | 0.32 |
| R | 2.21 | 0.15 | 2.25 | 0.29 |

The above results show the fact that when the compound of formula (I) or (II) of the present invention was added to the dye fixing layer, the increment of fog during the transfer step was substantially prevented.

EXAMPLE 3

10 g of Dye Forming Substance (4) (see below), 0.5 g of 2-ethylhexyl succinate/sodium sulfonate and 10 g of tricresyl phosphate were weighed, and 20 ml of cyclohexanone was added thereto and dissolved with heat at 60° C. to obtain a uniform solution. The resulting solution and 100 g of a 10% lime-treated gelatin aqueous solution were stirred and admixed, and then the resulting mixture was emulsified and disperesed in a homogenizer.

Next, Photographic Material (H) was prepared as follows:

| | | |
|---|---|---|
| (a) | Silver bromoiodide emulsion of Example 1 | 5.5 g |
| (b) | A 10% gelatin aqueous solution | 0.5 g |
| (c) | Dye forming substance dispersion as prepared above | 2.5 g |
| (d) | A 10% guanidine trichloroacetate/ethanol solution | 1 ml |
| (e) | A 10% 2,6-dichloro-4-aminophenol/methanol solution | 0.5 ml |
| (f) | A 5% aqueous solution of the following compound | 1 ml |

-continued

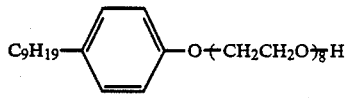

| | | |
|---|---|---|
| (g) | Gelatin dispersion of Compound (2) | 0.5 ml |
| (h) | Water | 6 ml |

Dye Forming Substance (4):

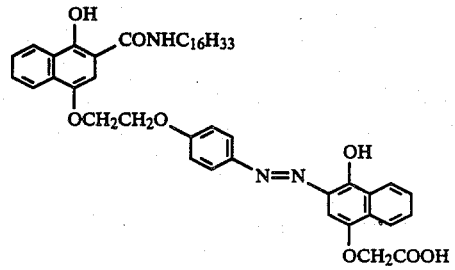

The above components (a) through (h) were admixed and dissolved by heat, and the resulting solution was coated on a polyethylene terephthalate film to form a coated film having a wet film thickness of 85 μm.

A protective layer of gelatin (1.5 g/m$^2$) was coated on the above-formed coated layer to obtain Photographic Material (H). This was imagewise exposed to a tungsten lamp at 2,000 lux for 10 seconds, and then uniformly heated on a heat block heated at 140° C. or 143° C. for 30 seconds.

Next, this was treated in the same manner as in Example 1, and the results are shown in Table 3 below.

TABLE 3

| Sample | Heated at 140° C. for 30 Seconds Maximum Density | Minimum Density | Heated at 143° C. for 30 Seconds Maximum Density | Minimum Density |
|---|---|---|---|---|
| (H) | 2.01 | 0.15 | 2.03 | 0.17 |

The above result proves the fact that the compound of the present invention is remarkably effective when used in a photographic material containing a dye forming substance which releases a dye by a coupling reaction of said substance with an oxidized product of a developing agent.

EXAMPLE 4

20 ml of cyclohexanone was added to a mixture of 5 g of Dye Forming Substance (5) (see below), 4 g of an electron donor having the following constitution, 0.5 g of 2-ethylhexyl succinate/sodium sulfonate and 10 g of tricresyl phosphate and heated at about 60° C. and dissolved. The others were the same as in Example 3, and a dispersion of a reducible dye forming substance was prepared.

Dye Forming Substance (5):

-continued

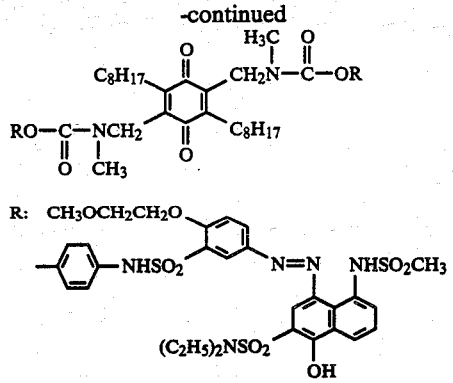

Electron Donor:

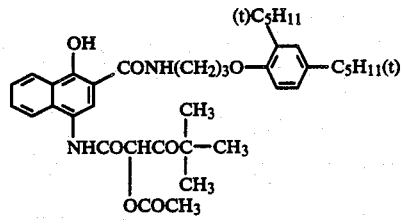

In the same manner as Photographic Material (H) in Example 3, with the exception that the above prepared reducible dye forming substance dispersion was used instead of the dispersion of Dye Forming Substance (4), another Photographic Material (I) was formed.

This Material (I) was exposed and treated in the same manner as in Example 3, and the results obtained are shown in Table 4 below.

TABLE 4

| | Heated at 140° C. for 30 Seconds | | Heated at 143° C. for 30 Seconds | |
|---|---|---|---|---|
| Sample | Maximum Density | Minimum Density | Maximum Density | Minimum Density |
| (I) | 1.82 | 0.19 | 1.85 | 0.21 |

The above results show the fact that the compound of the present invention is remarkably effective when used in a photographic material containing a reducible dye forming substance which forms a positive image with respect to the silver image.

EXAMPLE 5

A gelatin dispersion of a coupler was prepared as follows:

5 g of 2-dodecylcarbamoyl-1-naphthol, 0.5 g of 2-ethylhexyl succinate/sodium sulfonate and 2.5 g of tricresyl phosphate (TCP) were weighed, and 30 ml of ethyl acetate was added thereto and dissolved. The resulting solution and 100 g of a 10% gelatin solution were stirred and admixed and then the resulting mixture was emulsified in a homogenizer for 10 minutes (10,000 rpm) to obtain a dispersion.

Next, Photographic Material (J) was prepared as follows:

| | |
|---|---|
| (a) Silver bromoiodide (same as in Example 1) | 10 g |
| (b) Coupler-gelatin dispersion | 3.5 g |
| (c) Solution of guanidine trichloroacetate (0.25 g) as dissolved in ethanol (2.5 cc) | |
| (d) Gelatin (a 10% aqueous solution) | 5 g |
| (e) Solution of 2,6-dichloro-p-aminophenol (0.2 g) as dissolved in water (15 cc) | |
| (f) Gelatin dispersion of Compound (2) of the present invention (same as in Example 1) | 1 ml |

A coating solution comprising the above components was coated on a polyethylene terephthalate film support to form a coated film having a wet film thickness of 60 μm, and dried to obtain a photographic material.

This material was imagewise exposed to a tungsten lamp at 2,000 lux for 5 seconds. Afterwards, this was uniformly heated on a heat block heated at 150° C. or 15° C. for 20 seconds to obtain a cyan image. The density of the image formed was measured with Macbeth transmission densitometer (TD-504), and the results are shown in Table 5 below.

TABLE 5

| | Heated at 150° C. for 20 Seconds | | Heated at 153° C. for 20 Seconds | |
|---|---|---|---|---|
| Sample | Maximum Density | Minimum Density | Maximum Density | Minimum Density |
| (J) | 2.08 | 0.18 | 2.10 | 0.2 |

The above results show the fact that the compound of the present invention has a high temperature compensatory effect.

EXAMPLE 6

This example illustrates one embodiment of a black-and-white photographic material.

Photographic Material (K) was prepared as follows:

| | |
|---|---|
| (a) Silver bromoiodide emulsion (same as in Example 1) | 1 g |
| (b) Silver benzotriazole emulsion (same as in Example 2) | 10 g |
| (c) A 10% guanidine trichloroacetate/ethanol solution | 1 cc |
| (d) A 5% methanol solution of the following compound | 2 cc |

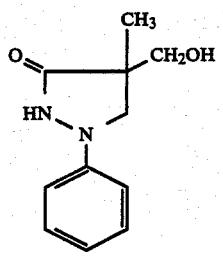

| | |
|---|---|
| (e) Gelatin dispersion of Compound (3) of the present invention (same as in Example 1) | 1 cc |

A coating solution comprising the above components was coated on a polyethylene terephthalate film support to form a coated film having a wet film thickness of 60 μm, and dried.

The thus-formed photographic material was imagewise exposed to a tungsten lamp at 2,000 lux for 5 seconds. Afterwards, this was uniformly heated on a heat block heated at 130° C. or 133° C. for 30 seconds to obtain a negative brown image. The density of the image formed was measured with Macbeth transmission Densitometer (TD-504), and the results are shown in Table 6 below.

TABLE 6

| | Heated at 130° C. for 30 Seconds | | Heated at 133° C. for 30 Seconds | |
|---|---|---|---|---|
| Sample | Maximum Density | Minimum Density | Maximum Density | Minimum Density |
| (K) | 0.86 | 0.12 | 0.90 | 0.15 |

The above results show the fact that the compound of the present invention has a high temperature compensatory effect.

While the invention has been described in detail and with reference to specific embodiments thereof, it will be apparent to one skilled in the art that various changes and modifications can be made therein without departing from the spirit and scope thereof.

What is claimed is:

1. A method for the formation of a photographic image including a heating step, comprising heating a diazo or silver halide photographic material in the presence of at least one compound selected from those represented by formulae (I) and (II)

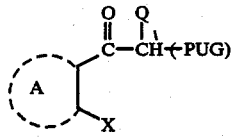
(I)

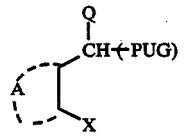
(II)

wherein

A represents a non-metallic atomic group forming a carbocyclic aromatic ring or a heterocyclic aromatic ring;

X represents a nucleophilic group selected from the group consisting of —OH, —$CO_2H$, 'CH$_2$OH, —$NH_2$, —$NHR^{11}$, —$SO_2NH_2$, and —SH, wherein $R^{11}$ represents an unsubstituted or substituted alkyl, cycloalkyl, alkenyl, aralkyl, aryl, heterocyclic, alkoxy, aryloxy, alkylthio, arylthio, or amino group or a precursor thereof;

$X^1$ represents a nucleophilic group selected from the group consisting of —$CO_2H$, —$SO_2NH_2$, —$CONH_2$, —$CONHR^{11}$, —$CH_2OH$, —$CH_2NH_2$, —$CH_2NHR^{11}$, —$CONHNH_2$, and —$NHNH_2$, wherein $R^{11}$ represents an unsubstituted or substituted alkyl, cycloalkyl, alkenyl, aralkyl, aryl, heterocyclic, alkoxy, aryloxy, alkylthio, arylthio, or amino group or a precursor thereof;

Q represents a hydrogen atom or a substituted or unsubstituted alkyl, cycloalkyl, or aryl group; and PUG represents a photographically useful group.

2. A method for the formation of a photographic image as in claim 1, wherin A in formulae (I) and (II) represents a non-metallic atomic group forming a carbocyclic aromatic ring having from 6 to 18 carbon atoms.

3. A method for the formation of a photographic image as in claim 1, wherein X in formulae (I) and $X_I$ in formula (II) represents a precursor of a nucleophilic group protected by a protective group represented by formula (A), (B), or (C)

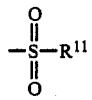
(A)

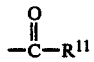
(B)

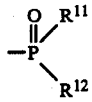
(C)

wherein $R^{11}$ and $R^{12}$ each represents an unsubstituted or substituted alkyl, cycloalkyl, alkenyl, aralkyl, aryl, heterocyclic, alkyloxy, aryloxy, alkylthio, arylthio, or amino group, or said $R^{11}$ and $R^{12}$ together form an unsubstituted or substituted 5- or 6-membered ring.

4. A method for the formation of a photographic image as in claim 1, wherein Q in formulae (I) and (II) represents a group selected from the group consisting of an unsubstituted or substituted alkyl, cycloalkyl, alkenyl, aralkyl, aryl, heterocyclic alkyloxy, aryloxy, alkylthio, arylthio, or amino group.

5. A method for the formation of a photographic image as in claim 1, wherein PUG in formulae (I) and (II) represents a group derived from a development inhibitor.

6. A method for the formation of a photographic image as in claim 5, wherein PUG in formulae (I) and (II) represents a group derived from a development inhibitor represented by formula (III)

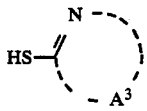
(III)

wherein $A^3$ represents an atomic group forming an unsubstituted or substituted 5- or 6-membered hetero ring, and said group represented by PUG is bound to the sulfur atom or nitrogen atom thereof.

7. A method for the formation of a photographic image as in claim 5, wherein PUG in formulae (I) and (II) represents a group derived from a development inhibitor represented by formula (IV)

$R^{17}$—SH (IV)

wherein $R^{17}$ represents an unsubstituted or substituted alkyl, cycloalkyl, aralkyl, alkenyl, or aryl group, and said group represented by PUG is bound to the sulfur atom or nitrogen atom thereof.

8. A method for the formation of a photographic image as in claim 7, wherein said development inhibitor is represented by formula (IV-1)

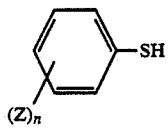
(IV-1)

wherein n is an integer selected from 1 to 5; Z represents a group defined in claim 10 for $R^{17}$, and when n is 2 or more, the Z's may be the same or different; and the group derived from said development inhibitor represented by formula (IV-1) is bound to the sulfur atom or nitrogen atom thereof.

9. A method for the formation of a photographic image as in claim 1, wherein said at least one compound represented by formulae (I) and (II) is used together with a base or precursor thereof.

10. A method for the formation of a photographic image as in claim 9, wherein the ratio of said base or precursor thereof to said at least one compound represented by formulae (I) and (II) is in the range of from 1/20 to 20/1 by mol.

11. A method for the formation of a photographic image as in claim 1, wherein said heating step is a heating step for development, a heating step for image transfer, or an imagewise heating step.

12. A method for the formation of a photographic image as in claim 1, wherein A in formulae (I) and (II) represents a non-metallic atomic group forming a carbocyclic aromatic ring or a heterocyclic aromatic ring having from 6 to 18 carbon atoms;

Q in formulae (I) and (II) represents a group selected from the group consisting of an unsubstituted or substituted alkyl, cycloalkyl, alkenyl, aralkyl, aryl, heterocyclic, alkyloxy, aryloxy, alkylthio, arylthio, or amino group; and PUG in formulae (I) and (II) represents a group derived from a development inhibitor.

13. A method for the formation of a photographic image as in claim 1, wherein the heating step is conducted at a temperature of from 60° C. to 180° C.

* * * * *